US010240614B2

(12) United States Patent
Long et al.

(10) Patent No.: US 10,240,614 B2
(45) Date of Patent: Mar. 26, 2019

(54) VENTILATION FAN

(71) Applicants: Panasonic Ecology Systems Guangdong Co., Ltd., Foshan, Guangdong (CN); Panasonic Corporation, Osaka (JP)

(72) Inventors: Min Long, Guangdong (CN); Qiuqian Liang, Guangdong (CN); Yefan Weng, Guangdong (CN); Shouyong Gao, Guangdong (CN); Bodong Zhong, Guangdong (CN); Zhengnan Zeng, Guangdong (CN); Daisuke Tsubosa, Aichi (JP)

(73) Assignees: PANASONIC ECOLOGY SYSTEMS GUANGDONG CO., LTD. (CN); PANASONIC CORPORATION (JP)

( * ) Notice: Subject to any disclaimer, the term of this patent is extended or adjusted under 35 U.S.C. 154(b) by 301 days.

(21) Appl. No.: 14/760,853

(22) PCT Filed: Sep. 12, 2014

(86) PCT No.: PCT/CN2014/086399
§ 371 (c)(1),
(2) Date: Jul. 14, 2015

(87) PCT Pub. No.: WO2015/043381
PCT Pub. Date: Apr. 2, 2015

(65) Prior Publication Data

US 2016/0195108 A1 Jul. 7, 2016

(30) Foreign Application Priority Data

Sep. 25, 2013 (CN) ..... 2013 2 0594435 U
Dec. 11, 2013 (CN) ..... 2013 2 0815256 U
Dec. 11, 2013 (CN) ..... 2013 2 0815297 U

(51) Int. Cl.
*F04D 29/62* (2006.01)
*F04D 29/42* (2006.01)
(Continued)

(52) U.S. Cl.
CPC ..... *F04D 29/624* (2013.01); *F04D 25/08* (2013.01); *F04D 29/282* (2013.01);
(Continued)

(58) Field of Classification Search
CPC ..... F04D 17/00; F04D 17/06; F04D 17/08; F04D 17/16; F04D 17/165; F04D 25/02;
(Continued)

(56) References Cited

U.S. PATENT DOCUMENTS 8,210,806 B2 7/2012 Yang
2008/0318515 A1* 12/2008 Yeung ..... F04D 29/4206 454/354
(Continued)

FOREIGN PATENT DOCUMENTS

CN 2513637 10/2002
CN 101025164 8/2007
(Continued)

OTHER PUBLICATIONS

International Search Report for International Application No. PCT/CN2014/086399 dated Dec. 17, 2014.

*Primary Examiner* — Justin D Seabe
*Assistant Examiner* — Alexander A White
(74) *Attorney, Agent, or Firm* — RatnerPrestia

(57) ABSTRACT

A ventilator includes an opening formed on a bottom surface, a rectangular frame provided with a flange, a volute provided with a fan motor inside, and a connector connected to an air outlet of the volute. Four side surfaces of the frame excluding the top surface and the bottom surface tilt towards the outer lower side in a direction from the top surface to the
(Continued)

bottom surface, and the opening area of the bottom surface is larger than that of the top surface. The ventilator saves packaging and installation costs, and further facilitates installation between the roof and the ceiling.

7 Claims, 22 Drawing Sheets

(51) Int. Cl.
*F04D 25/08* (2006.01)
*F04D 29/28* (2006.01)
*F04D 29/60* (2006.01)

(52) U.S. Cl.
CPC ..... *F04D 29/4226* (2013.01); *F04D 29/4233* (2013.01); *F04D 29/602* (2013.01); *F04D 29/626* (2013.01)

(58) Field of Classification Search
CPC ..... F04D 25/08; F04D 25/088; F04D 25/12; F04D 29/282; F04D 29/40; F04D 29/403; F04D 29/4226; F04D 29/4233; F04D 29/424; F04D 29/4246; F04D 29/4253; F04D 29/522; F04D 29/541; F04D 29/545; F04D 29/602; F04D 29/603; F04D 29/624; F04D 29/626; F05B 2240/14; F05B 2250/13; F05B 2250/21; F05B 2250/32; F24F 7/007; F24F 7/02; F24F 7/04; F24F 7/06; F24F 7/065; F24F 13/02; F24F 13/0209; F24F 13/0254; F24F 2013/205; F24F 2221/36; B65D 57/00; B65D 59/06; B65D 59/08; B65D 61/00; B65D 69/00; B65D 71/00; B65D 71/50; B65D 71/502; B65D 77/00; B65D 77/24; B65D 77/26; B65D 85/62; B65D 85/64; B65D 85/68
See application file for complete search history.

(56) References Cited

U.S. PATENT DOCUMENTS

| | | | | |
|---|---|---|---|---|
| 2009/0191051 | A1* | 7/2009 | Bagepalli | F03D 80/00 415/182.1 |
| 2013/0051999 | A1* | 2/2013 | Wenger | F04D 25/08 415/200 |

FOREIGN PATENT DOCUMENTS

| | | |
|---|---|---|
| CN | 201071837 | 6/2008 |
| CN | 101844653 | 9/2010 |
| CN | 203476755 | 3/2014 |
| CN | 203601805 | 5/2014 |
| CN | 203771656 | 8/2014 |
| JP | 4503323 | 7/2010 |

* cited by examiner

10

VENTILATION FAN

CROSS-REFERENCE TO RELATED APPLICATIONS

This patent application is a U.S. National Phase Patent Application of PCT Application No. PCT/CN2014/086399, filed Sep. 12, 2014, which claims priority to Chinese Patent Application No. 201320594435.4, filed Sep. 25, 2013, Chinese Patent Application No. 201320815297.8, filed Dec. 11, 2013, and Chinese Patent Application No. 201320815256.9, filed Dec. 11, 2013, each of which is incorporated by reference herein in its entirety.

FIELD OF THE INVENTION

The present invention relates to the technical field of ventilation fan, and specifically to a ventilation fan installed between a roof and a ceiling.

BACKGROUND OF THE INVENTION

Ventilation fan is commonly used ventilation equipment. A known ventilation fan generally comprises: a frame provided with an opening in a bottom surface thereof and a flange, the frame having a rectangular shape; a casing with a fan motor installed therein; and an adapter connected to an outlet of the casing. And a ventilation fan installed between a roof and a ceiling is usually mounted through a bracket or a hanger, or through providing a bore in the flange of the frame and threading a screw to pass through the bore in the flange and a gap and into a specific joist which has the same width with the frame, so that the frame is mounted to the joist.

The components (such as, frame, casing, adapter, and the like) of the above known ventilation fan can be packed separately, and a user should assembly the components together after purchase. When packaging several frames integrally, since a volume of a frame is large, there is a need for more packing materials, which leads to a relative high cost for the packaging.

Moreover, when mounting the conventional ventilation fan to the joist, there needs a bracket or a hanger, such that not only the cost for mounting is increased, but also additional installation steps and hours are needed.

In the method of threading a screw to pass through the bore in the flange and a gap and into a specific joist having the same width with the frame so as to mount the frame to the joist, the gap between joists should be the same as the width of the frame, which limits of the usage of the method.

SUMMARY OF THE INVENTION

An object of the present invention is to provide a ventilation fan that can save the costs for packing and installation, and at the same time, can make the installation of the fan between a roof and a ceiling easier.

In order to realize the above object, the present invention provides a ventilation fan comprising: a frame provided with an opening in a bottom surface thereof and a flange, the frame having a rectangular shape; a casing with a fan motor installed therein; and an adapter connected to an outlet of the casing, wherein four side surfaces of the frame, except a top surface and the bottom surface thereof, incline outwards and downwards from the top surface to the bottom surface, an area of the opening in the bottom surface is larger than an area of the top surface.

The present invention can save packing package and installation costs, and make the installation of the fan between a roof and a ceiling easier.

DETAILED DESCRIPTION OF PREFERRED EMBODIMENTS OF THE INVENTION

Figure 1A:
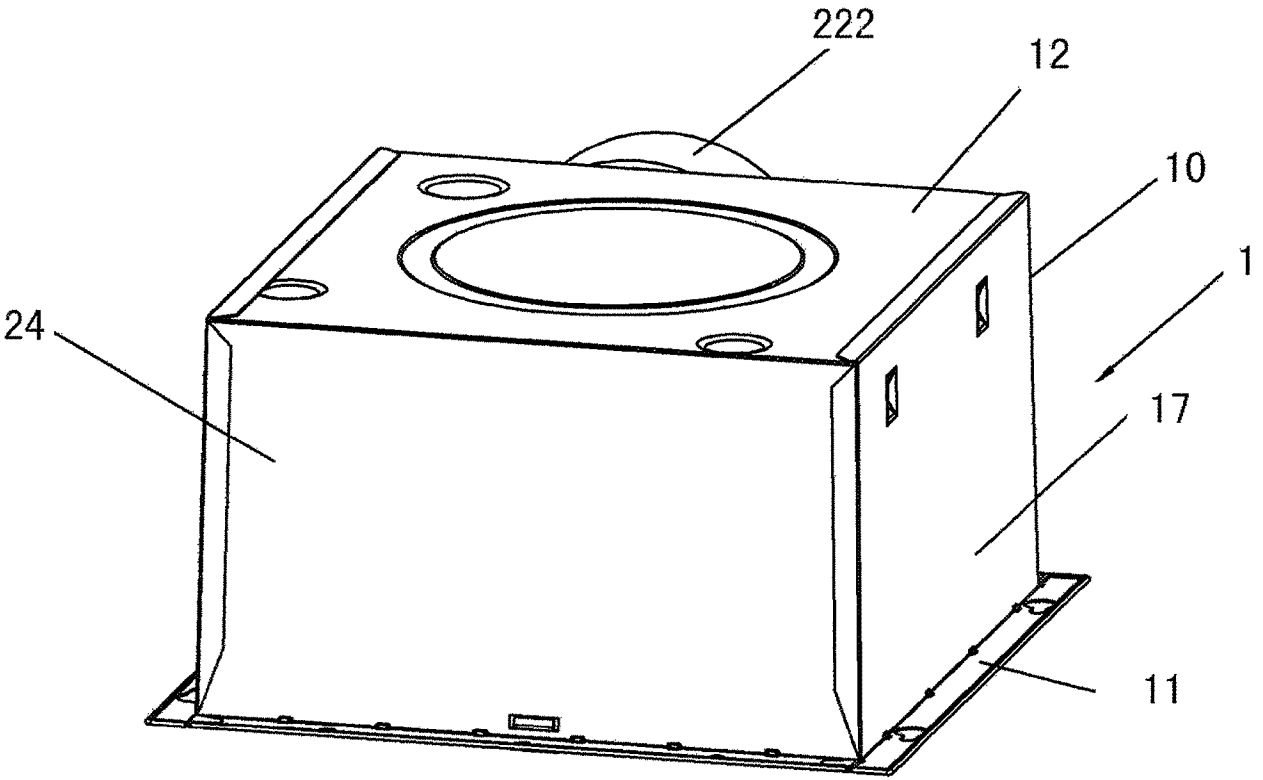
FIGS. 1A, 1B, and 1C are schematic diagrams showing a first embodiment of the present invention.
Figure 1B:
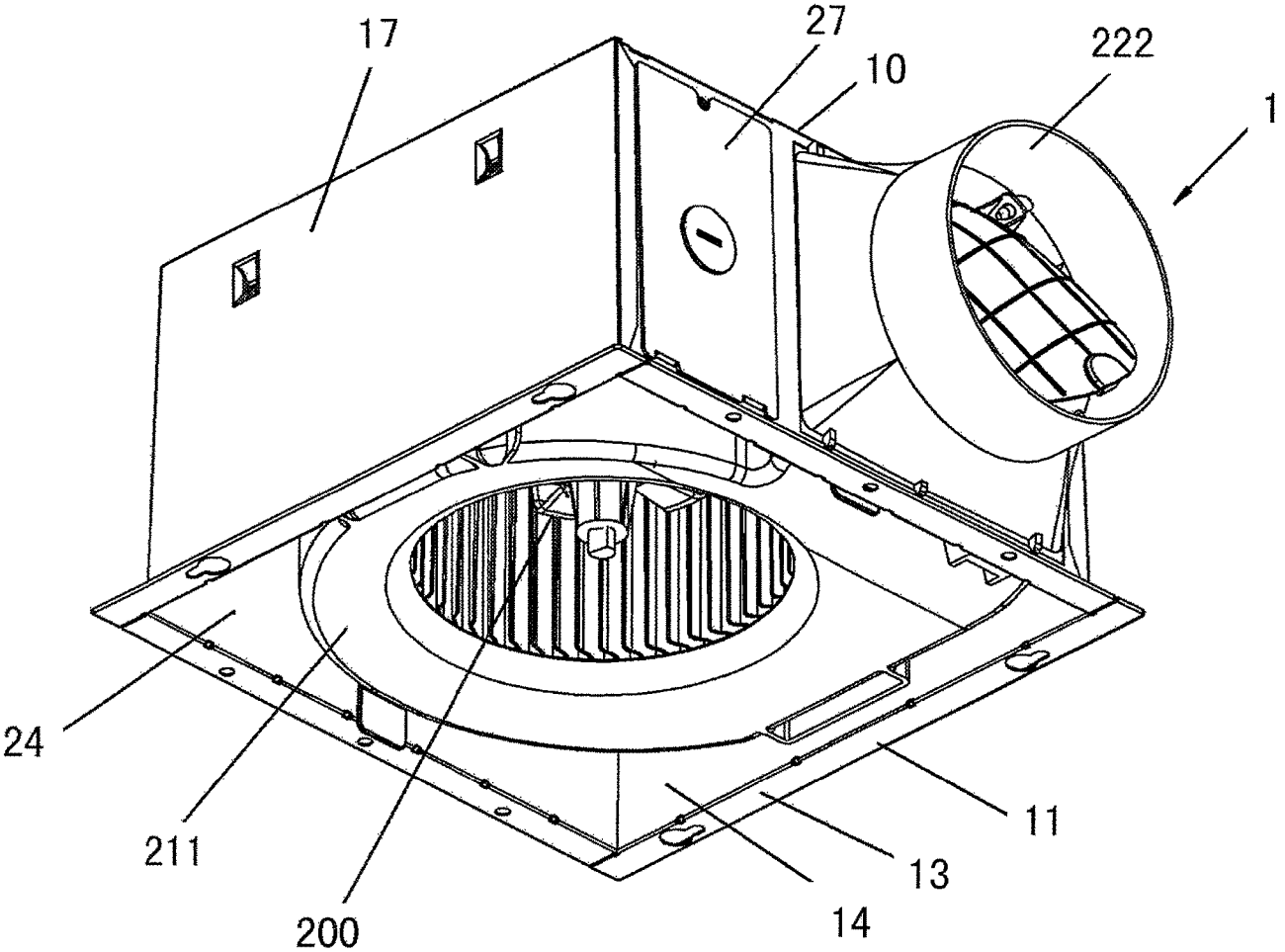
Figure 1C:
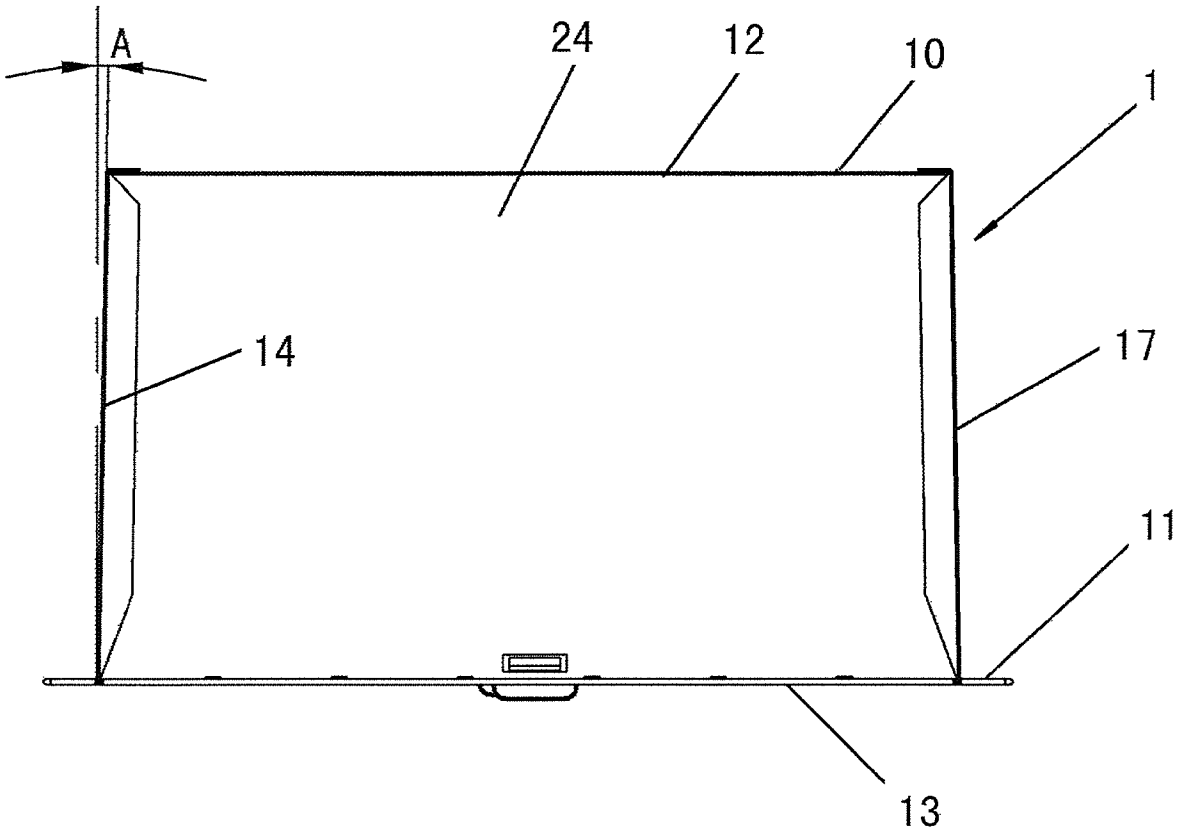
Figure 2A:
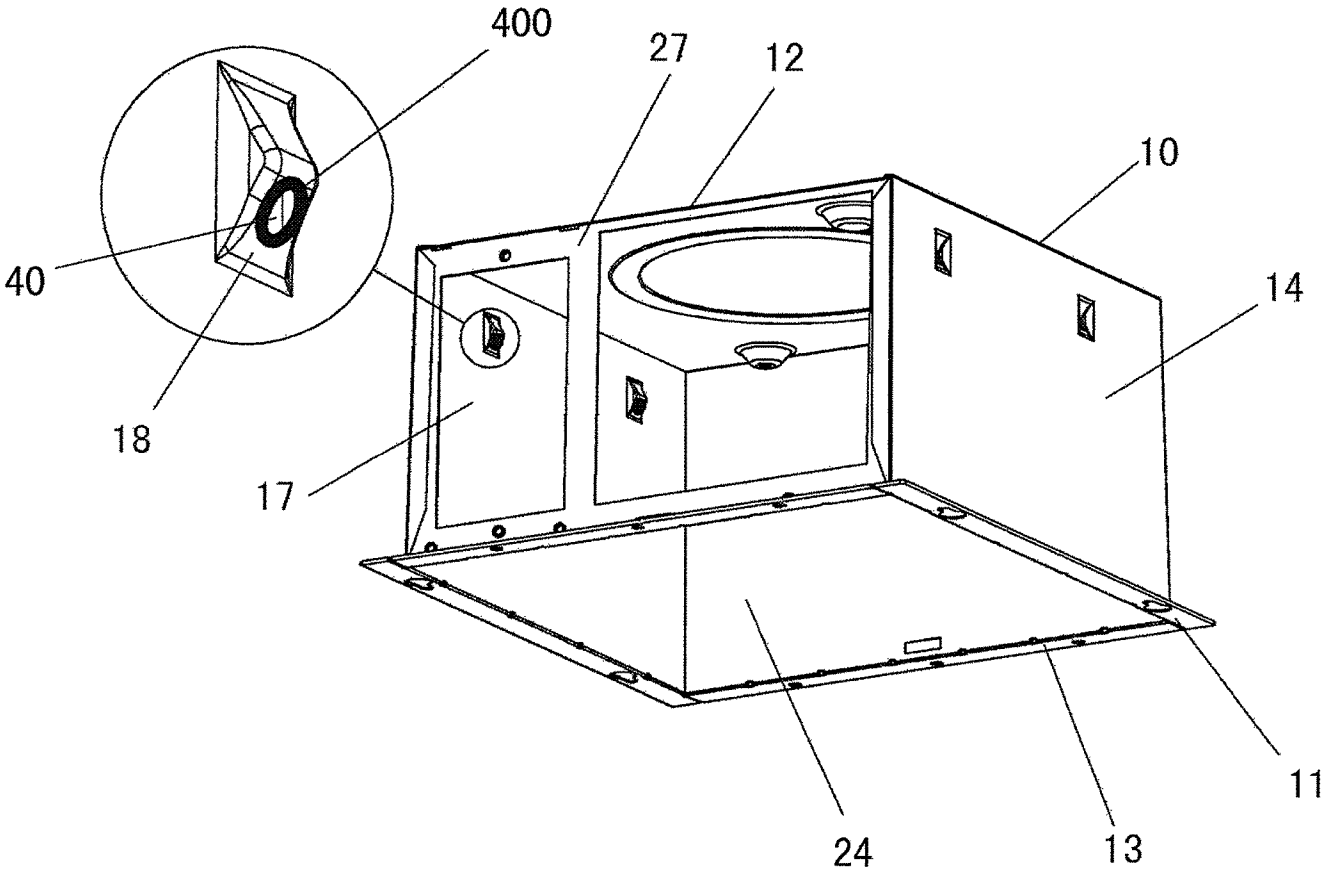
FIGS. 2A and 2B are schematic diagrams showing a frame of the first embodiment of the present invention.
Figure 2B:
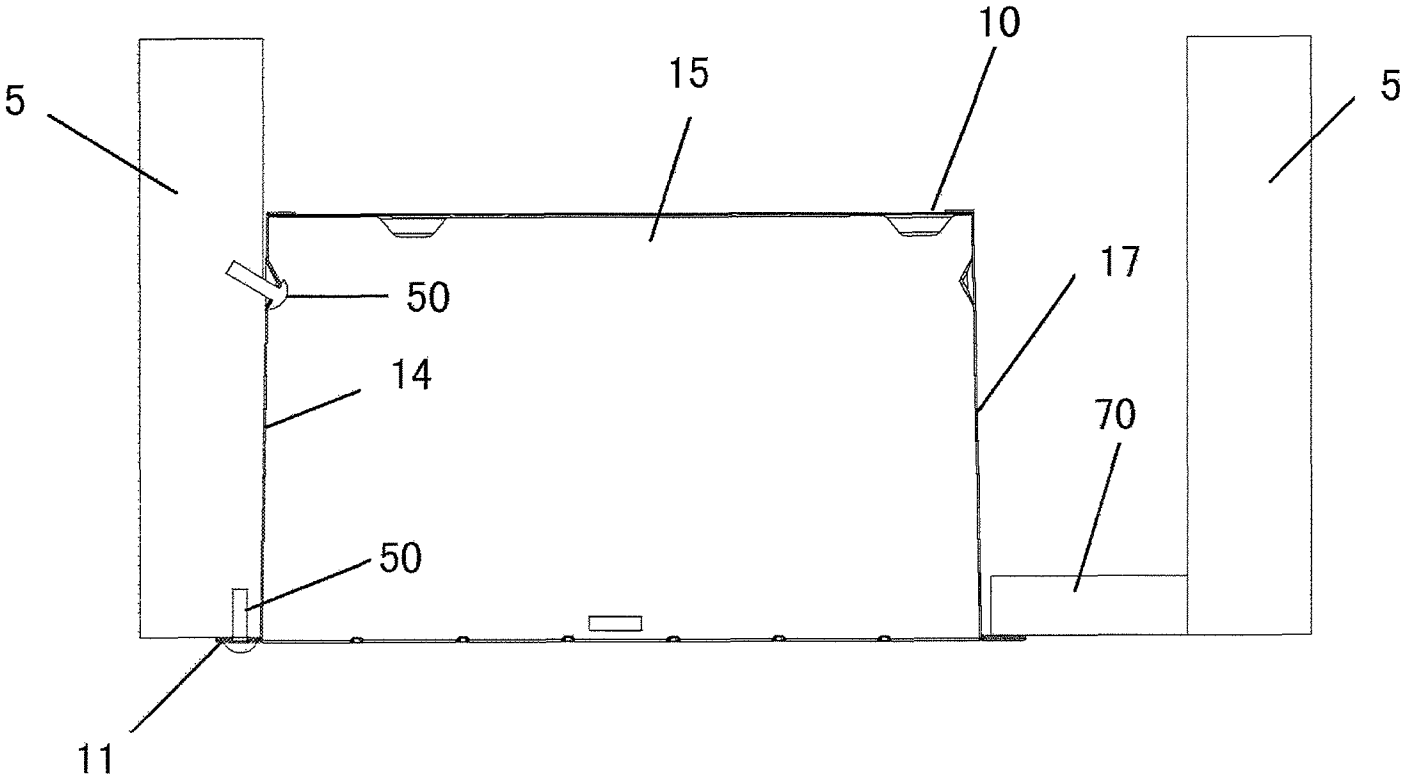

FIGS. 1A, 1B, and 1C are schematic diagrams of a first embodiment of the present invention; FIGS. 2A, 2B are schematic diagrams of a frame of the first embodiment of the present invention. As illustrated, a ventilation fan 1, includes: a rectangular frame 10 provided with a flange 11 and having an opening in a bottom surface 13, a casing 211 with a fan motor 200 installed therein, and an adapter 222 which is connected to an air outlet of the casing 211. Except a top surface 12 and the bottom surface 13, other four side surfaces 14, 17, 24, 27 of the frame 10 incline outwards and downwards from the top surface 12 to the bottom surface 13, an area of the opening in the bottom surface 13 is larger than that of the top surface 12, i.e. a width of frame 10 increases gradually from the top surface 12 to the bottom surface 13. That is to say, the opening of the frame 10 expends from its top surface 12 through the four side surfaces 14, 17, 24, 27 towards the bottom surface 13.

With the above structure, when longitudinally arranging several frames 10 for an integrated packing, storage or transport, an opening in the bottom of an upper frame (hereinafter, "upper frame" for short) can cover top portions of a part of the frames located under the upper frame (hereinafter, "lower frame" for short) in a downward direction. In another word, the top surface of the lower frame can be inserted into the opening in the bottom surface of the upper frame.

The larger an angle A of the four side surfaces 14, 17, 24, and 27 of frame 10 inclining outwards and downwards from the top surface 12 to the bottom surface 13 is, the larger an area ratio between the area of the opening in the bottom surface 13 of the frame 10 and the area of the top surface 12 thereof, and the deeper the top surface of the lower frame can go into the opening in the bottom surface of the upper frame, such that a volume of the stacked frames is reduced, that is, gaps between the stacked frames are decreased, thereby saving the packing materials for packaging the several frames.

However, the inclination angle A of the four side surfaces 14, 17, 24 and 27 are set to a range from 0.5 to 5 degrees, preferably from 1 to 2 degrees. Since the inclination angle A is relatively small, it won't cause a significant influence to the product performance.

Since the four side surfaces 14, 17, 24 and 27 of frame 10 incline outwards and downwards from the top surface 12 to the bottom surface 13 and thereby the top surface 12 has a smaller area and the opening in the bottom surface 13 has a larger area, when the ventilation fan 1 is needed to be replaced and an opening in the ceiling 70 is small, the frame 10 can be pushed into the opening in the ceiling 70 from below. That is, when the frame 10 is to be positioned between the roof and the ceiling, the top surface with a smaller area goes first into the opening in the ceiling 70, such that the entire frame 10 can be easily and smoothly pushed into the opening in the ceiling 70.

Further, as shown in FIGS. 2A and 2B, two opposite side surfaces 14 and 17 of the rectangular frame 10 have projecting surfaces 18 which project from the inner side of frame 10 and inclines upwards from the two side surfaces 14 and 17 of frame 10. Said projecting surfaces 18 are provided with bores 40 for fixing the frame 10 to joists 5.

When amounting the ventilation fan 1 between two joists 5, a screw 50 passes through the surface 14 of the frame 10 and a joist 5, and another screw 50 passes through the flange 11 and the joist 5, so that the frame 10 is mounted to the joist 5, from the inner side of frame 10. The bores 40 are provided at an upper part of the two opposite surfaces 14 and 17 of the frame 10, and the frame 10 may be mounted to the two joists 5 at any position. The casing 211 and the adapter 222 may be directly mounted after the frame 10 is mounted, so that no bracket or hanger is needed for installation, and such an installation is applicable for a small sized ventilation fan. Additionally, regardless the distance between the two joists 5, the ventilation fan 1 may be mounted to any one of the joists 5.

Elastic material 400, such as rubber, is provided around the bore 40 at an inner side of the frame 10. The screw 50 passes through the inner side of the frame 10, and the head of the screw 50 contacts with the elastic material 400 and is buried into the bore 40. So that, even if a force transmitted through the screw 50 is excessively large, such a excessive force won't be transmitted to the projecting surface 18 because of the buffering effect of the elastic material 400, such that the projecting surface 18 can be protected from deformation or damage caused by the excessive force.

Figure 3:
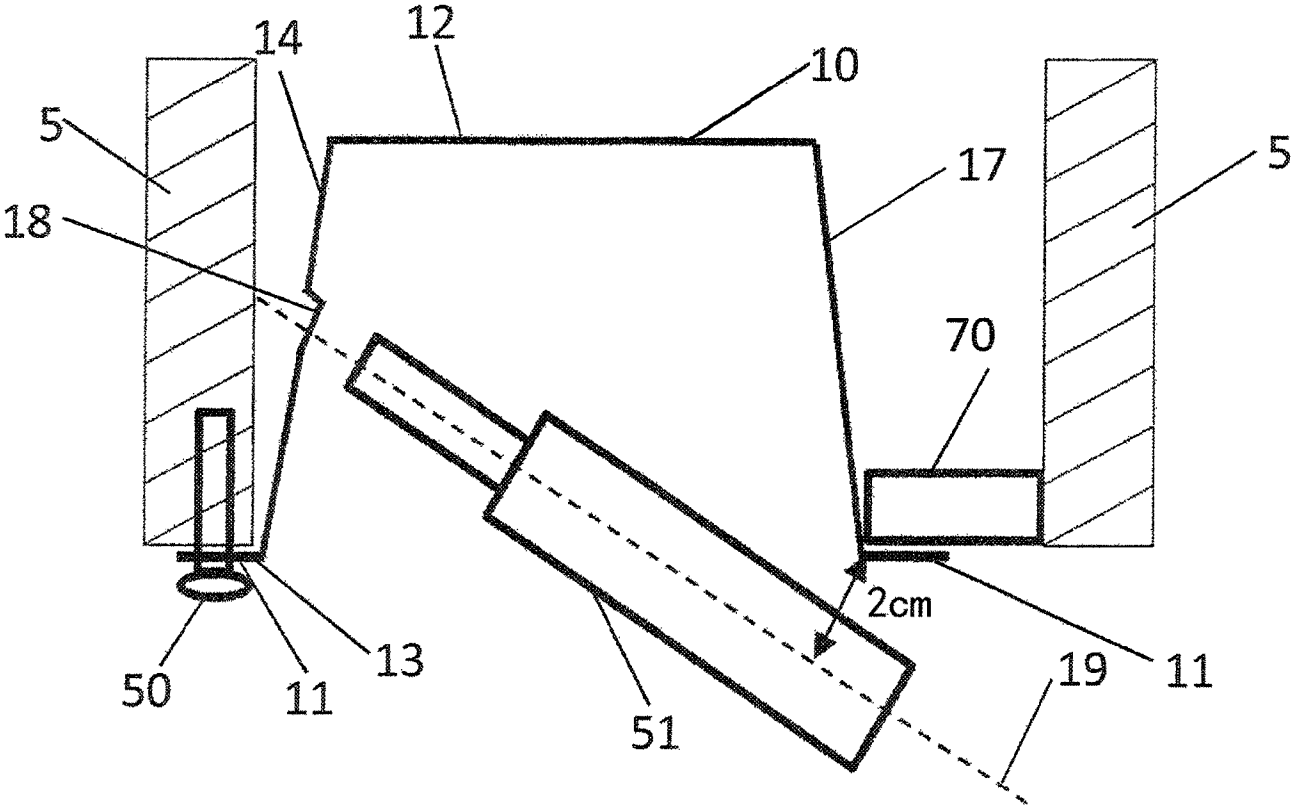
FIG. 3 is a first schematic section view showing the installation of the frame of the first embodiment of the present invention.

FIG. 3 is one of the schematic section views showing the installation of frame of the first embodiment of present invention. For the purpose of illustration, the inclination angle is demonstrated considerably large. So do FIGS. 4 and 5. In FIG. 3, usually a tool 51 (such as a manual screwdriver or an electrical screwdriver) for mounting the screw 50 is relative long, so that there is a possibility that the tool can't be put into the frame 10.

With the structure mentioned above, when a user threads the screw 50 from inner side of the frame 10 and passes it through the side surfaces 11 of frame 10 and the joist 5, the user may insert the screw 50 into the bore and thread the screw 50 with the tool 51 along a direction perpendicular to the projecting surface 18, as long as the inclination degree of the projecting surface 18 is large enough, as shown in FIG. 3, and a distance suitable for manual operation is left between a vertical line 19 of the projecting surface 18 and an end of the flange 11 on the side surface 17 opposite to the side surface 14 through which the screw 50 is passed, and the distance may be, for example, 2 cm, then the user could thread the screw 50 from outside of the opening in the bottom surface 13 of the frame 10, and won't be limited by the space inside the frame 10, which makes the installation convenient.

In addition, although the frame 10 is made of a metal, it's not a rigid body, so that when mounting the ventilation fan 1 to the joist 5 on one side, the weight of the ventilation fan 1 itself may deform the frame 10, and the other side of the frame 10 without a screw 50 will drop down slightly. If a louver is mounted to a deformed frame 10, a face plate might project from the ceiling 70 and affect the appearance.

Figure 4:
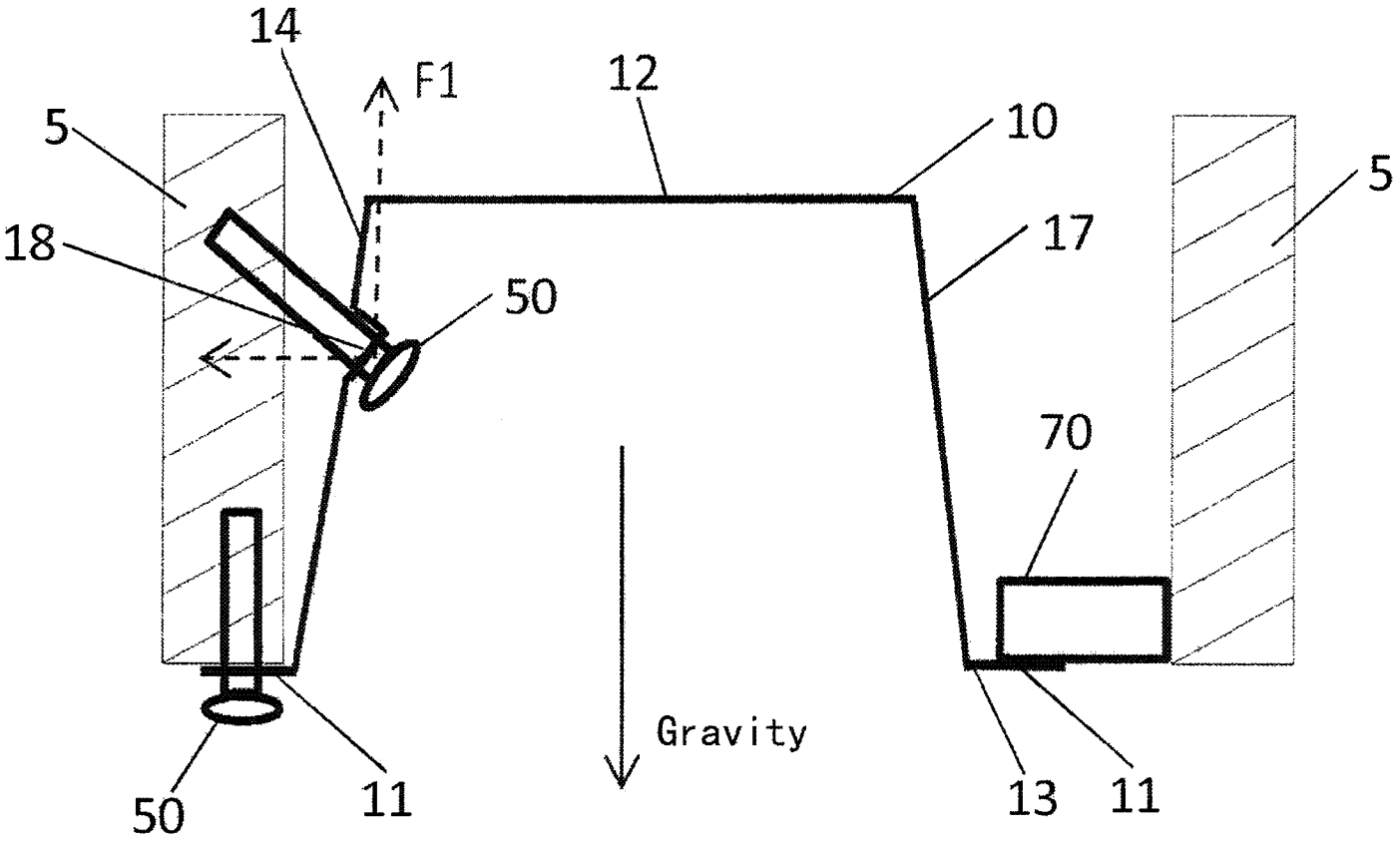
FIG. 4 is a second schematic section view showing the installation of the frame of the first embodiment of the present invention.

FIG. 4 is a second schematic section view showing the installation of the frame of the first embodiment of present invention. As illustrated, the frame 10 is fixed to the joist 5 by inserting a screw 50 vertically through the inclined projecting surface 18.

Figure 5:
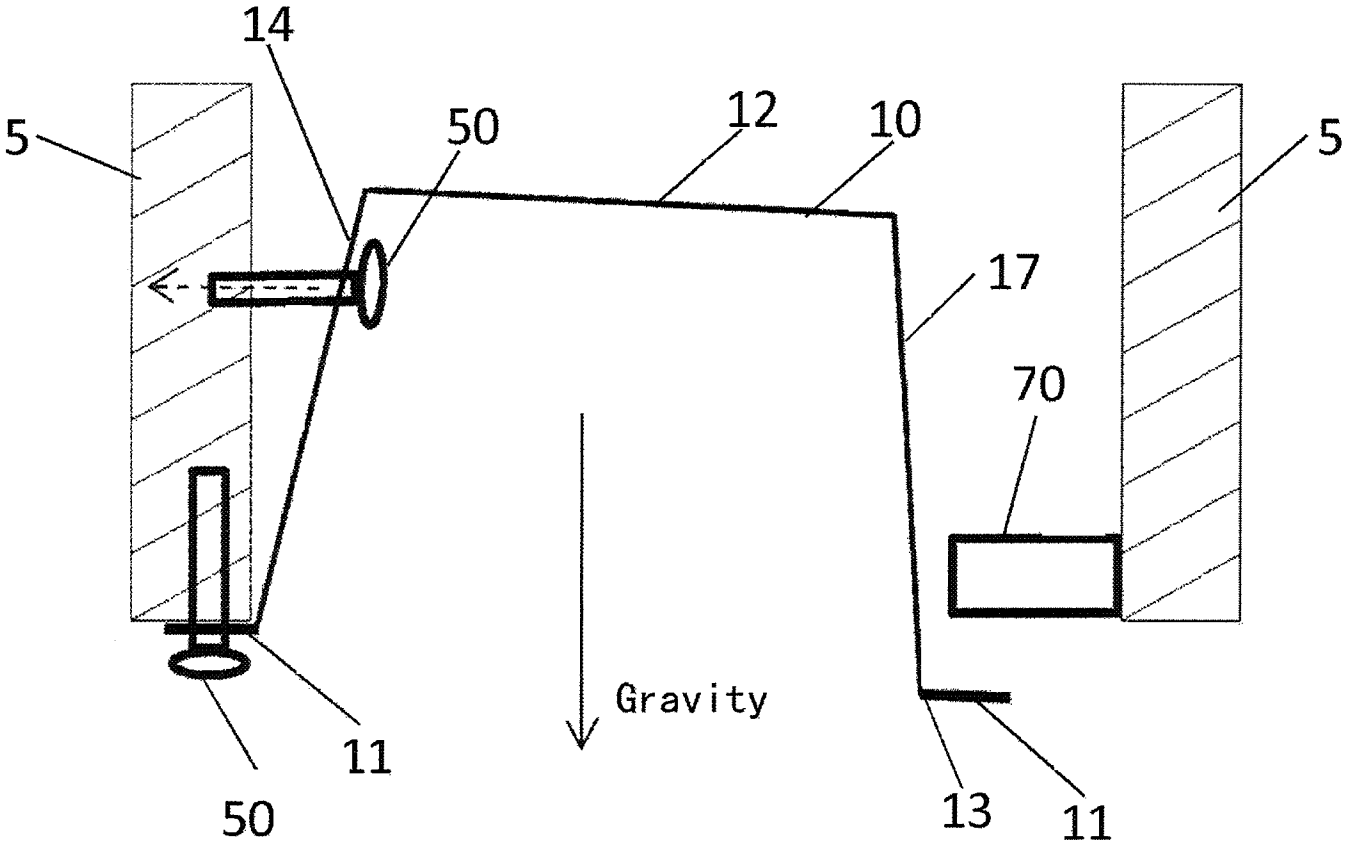
FIG. 5 is the schematic section view showing the installation of the frame of the first embodiment of the present invention, assuming that no projecting surface is used.

FIG. 5 is a schematic section view showing the installation of the frame of the first embodiment of the present invention, assuming that no projecting surface is used. As shown, the screw 50 is horizontally passed through the side surface 14 of the frame 60.

When comparing the frames shown in FIGS. 4 and 5, it can be seen that the screw 50 in FIG. 4 creates an additional upward force, i.e. upward thrust force F1, to prevent the bottom of the side surface 14 of the frame 10 close to the joist 5 from being deformed by gravity. It makes the installation between the roof and the ceiling 70 convenient, and improves the stability after the installation.

Figure 6A:
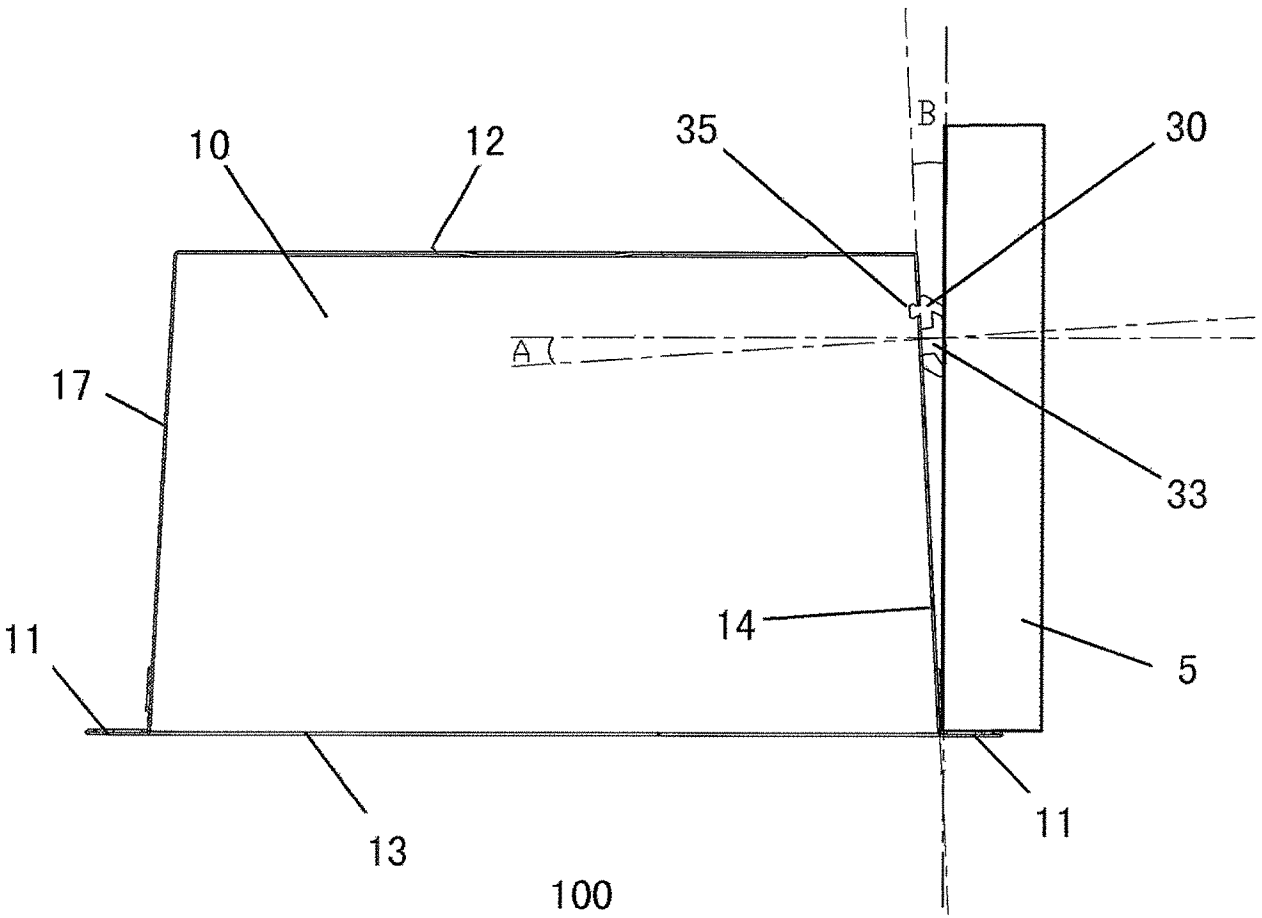
FIG. 6A is a schematic diagram showing the installation of a second embodiment of the present invention.
Figure 6B:
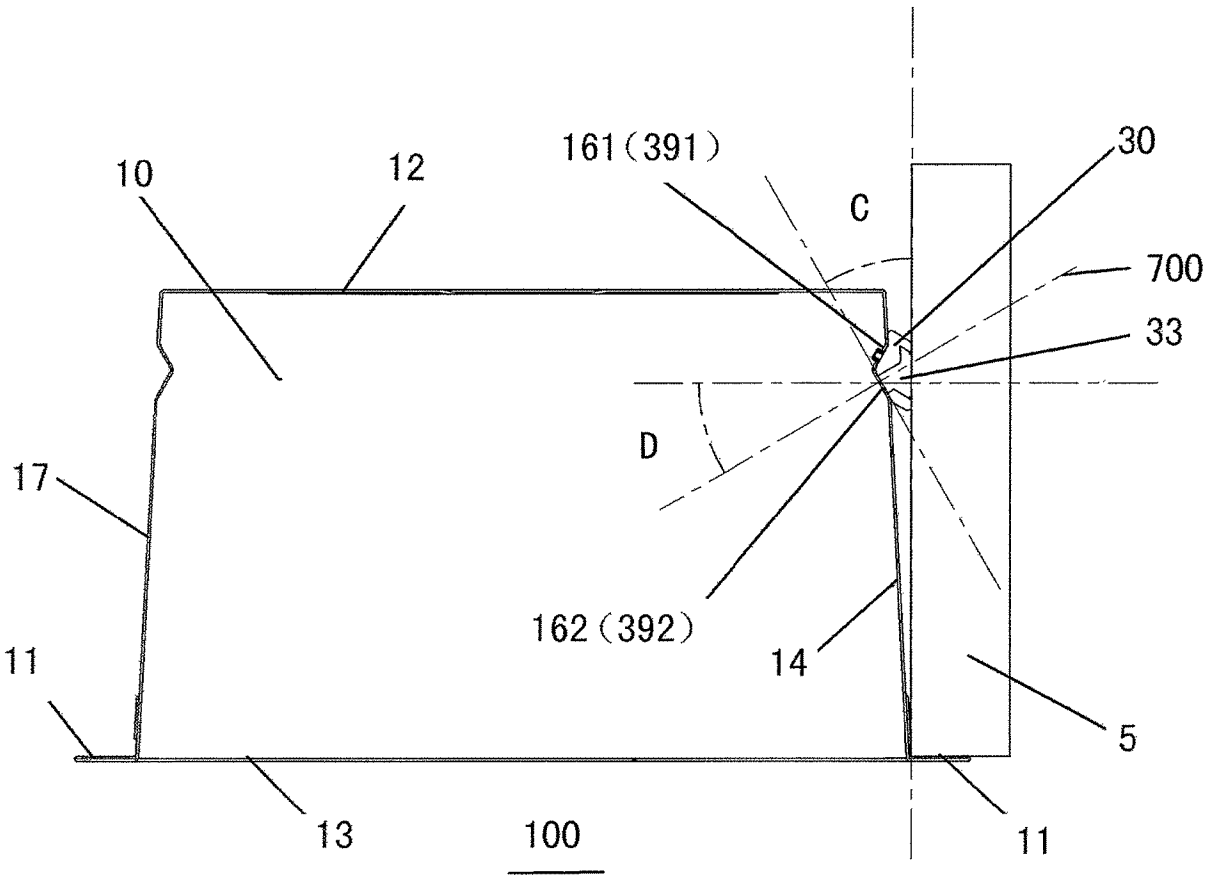
FIG. 6B is the schematic diagram showing the installation of the second embodiment of the present invention, where the frame has a concave section.
Figure 7:
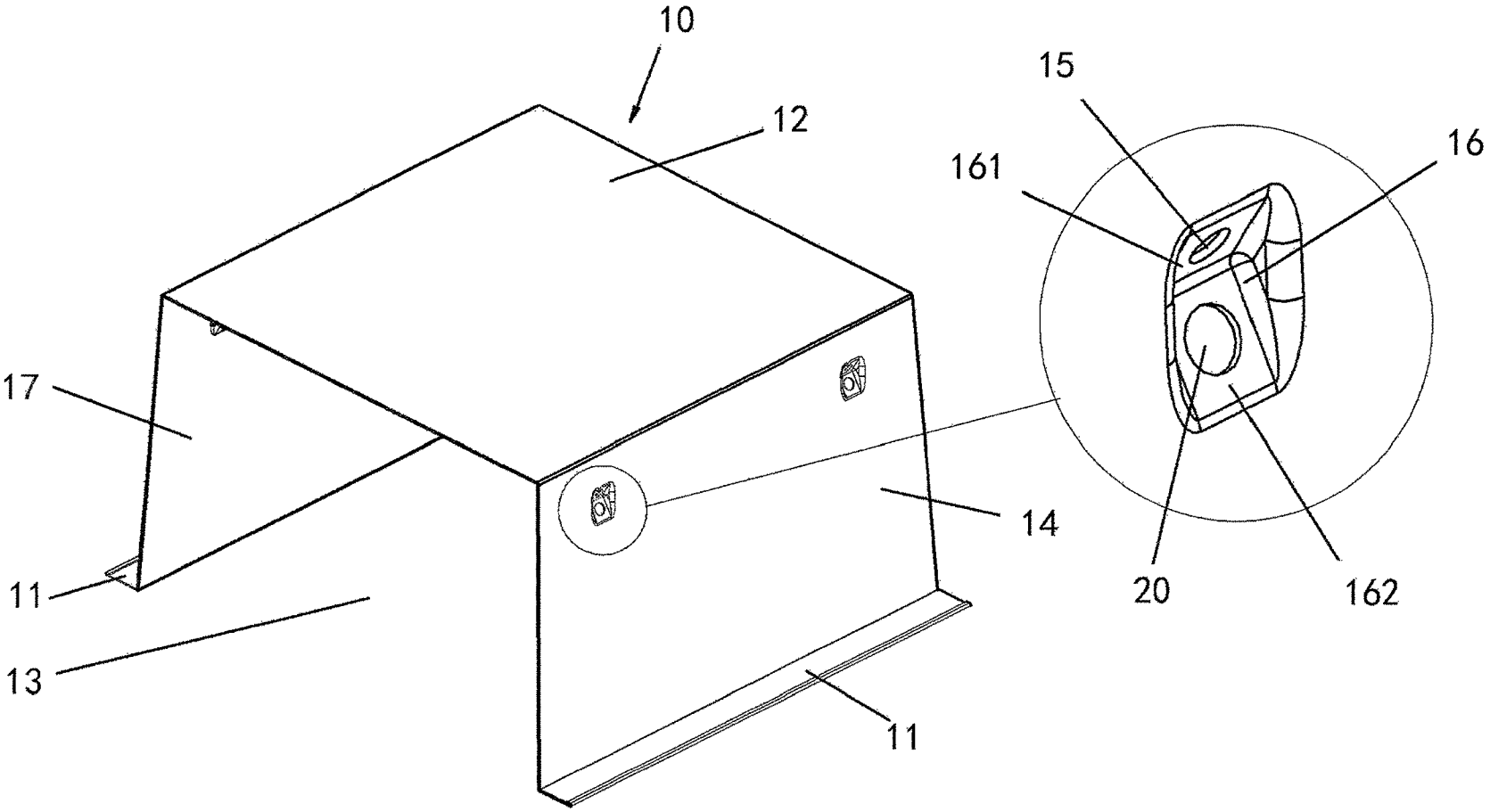
FIG. 7 is a schematic diagram showing the frame of the second embodiment of the present invention, where a part of the side surfaces has been removed.
Figure 8A:
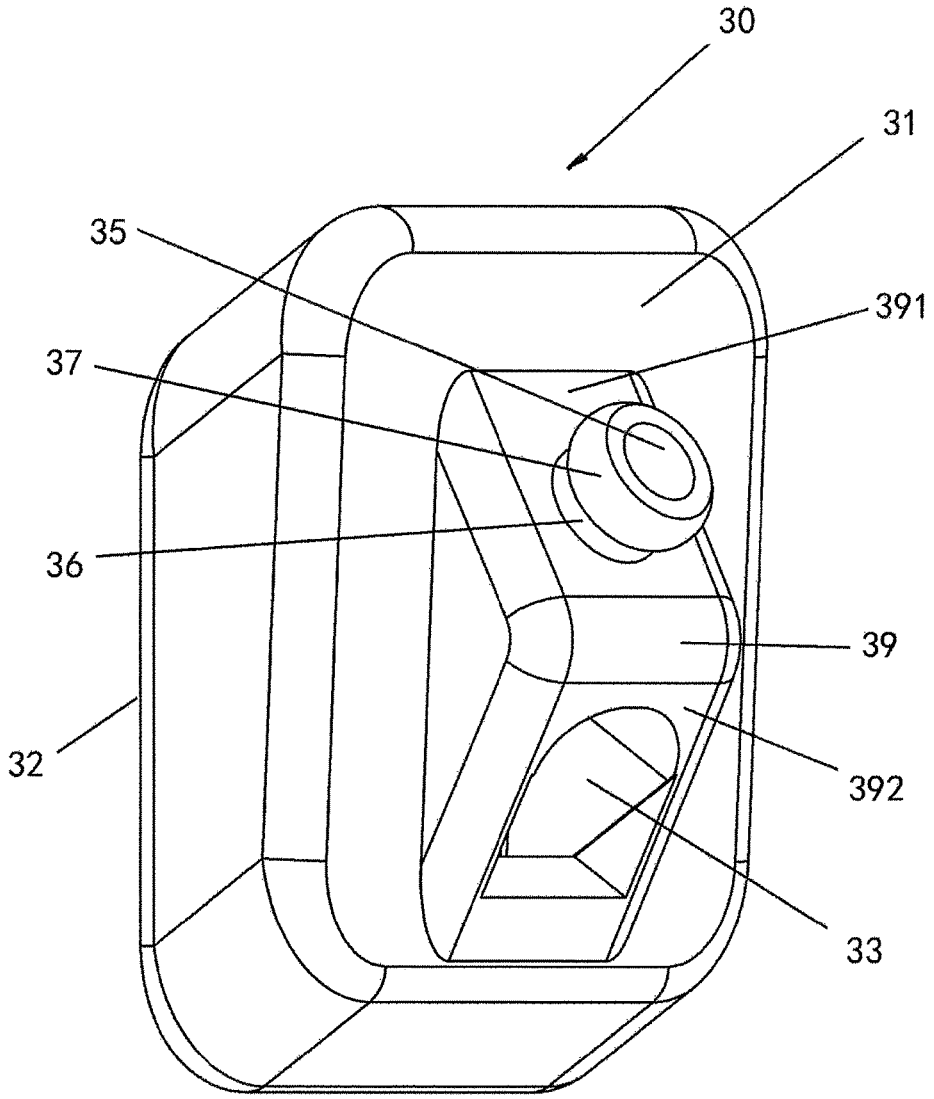
FIG. 8A is a schematic diagram showing a mounting spacer of the second embodiment of the present invention.
Figure 8B:
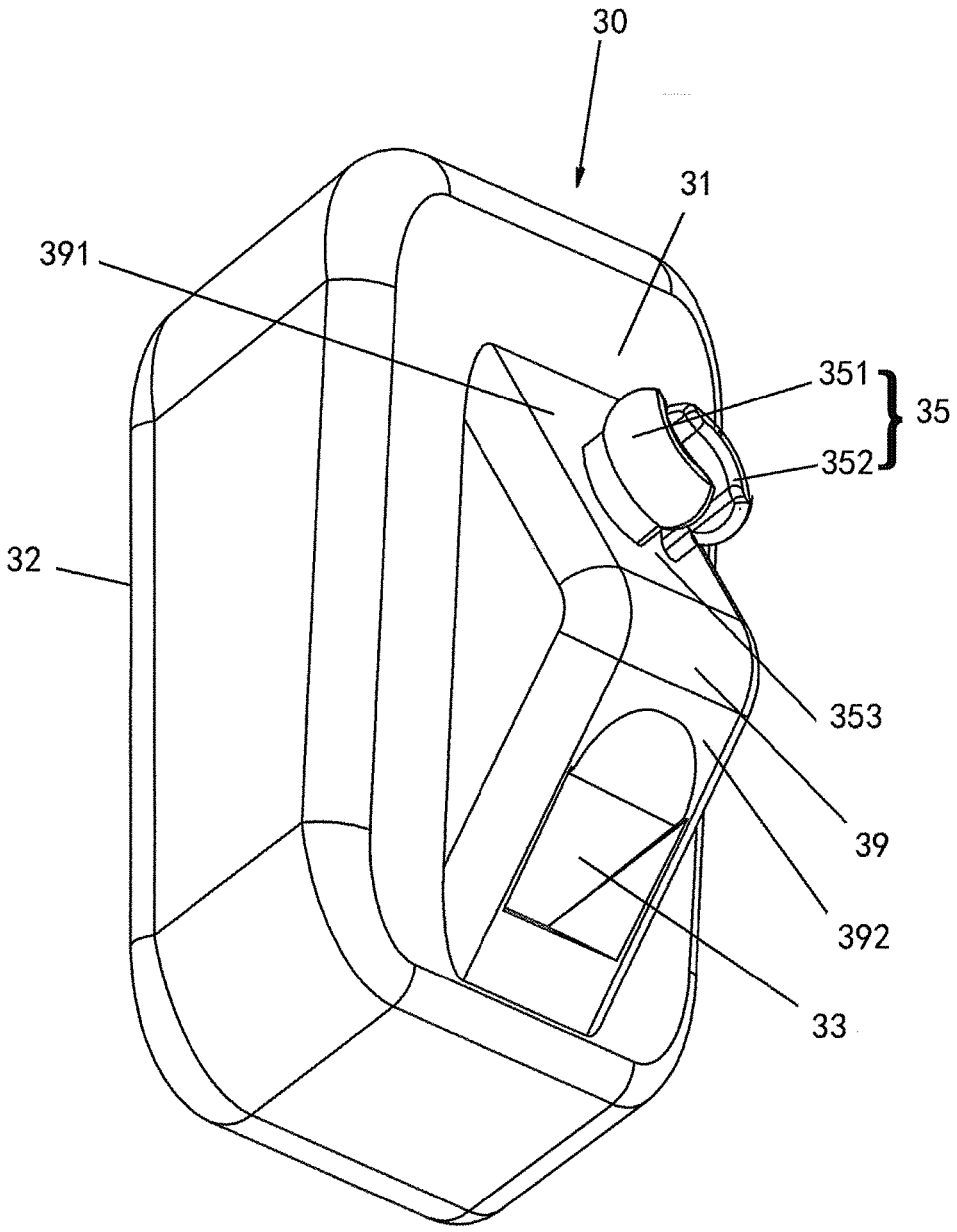
FIG. 8B is a schematic diagram showing another mounting spacer of the second embodiment of the present invention.

FIG. 6A is a schematic diagram showing the installation of the second embodiment of the present invention; FIG. 6B is a schematic diagram showing the installation of the second embodiment of the present invention where the frame has a concave section; FIG. 7 is a schematic diagram showing the frame of the second embodiment of the present invention where a part of the side surfaces has been removed; FIG. 8A is a schematic diagram showing a mounting spacer of the second embodiment of the present invention; FIG. 8B is a schematic diagram showing another mounting spacer of the second embodiment of the present invention.

As shown, the bottom surface 13 is provided with the flange 11, and the frame 10 is installed on the joist 5. Except the top surface 12 and the bottom surface 13, other four side surface 14, 17 (only 2 side surfaces are shown in FIGS. 6-8B) of the frame 10 incline outwards and downwards from the top surface 12 to the bottom surface 13. A bore 20 is provided in the side surface 14 of the frame 10. A mounting spacer 30, which can be mounted to the bore 20, is provided between the frame 10 and the joist 5. The mounting spacer 30 is provided with a mounting hole 33 penetrating the mounting spacer 30 from an inner side surface 31 to an outer side surface 32. The mounting spacer 30 is shaped that the inner side surface 31 is parallel with adjacent side surface 14 of the frame 10, while the outer side surface 32 is parallel with the joist 5.

In the present invention, the surface of the mounting spacer 30 adjacent to the side surface 14 of the frame 10 is referred as the inner side 31, while the surface adjacent to the side surface 14 of the joist 5 is referred as the outer side surface 32.

Before fixing the frame 10 to the joist 5, firstly, the mounting spacer 30 is fixed to the side surface 14 of the frame 10 facing the joist 5 after the mounting hole 33 in the mounting spacer 30 is aligned with the bore 20 in an upper part of the side surface 14 of the frame 10, then the frame 10 is lifted up to a position where the joist 5 is located, and a screw (not shown) is passed upwardly from the inner side of the bottom surface 13 of the frame 10, through the bore 20 in the side surface 14 of the frame 10 and the mounting hole 33 in the mounting spacer 30, and then to the joist 5. As the mounting spacer 30 is mounted between the side surface 14 of the frame 10 and the joist 5, and the shape of mounting spacer 30 is that the inner side 31 of the mounting spacer is in parallel with the adjacent side surface 14 of the frame 10 and the outer side 32 is in parallel with the joist 5, the mounting spacer 30 can therefore fill the gaps between the side surface 14 of the frame 10 and the joist 5.

When the technician punches the screw to an extent that the screw head (not shown) is pressed tightly against the inner side of the frame 10, as the mounting spacer 30 has filled the gaps between the side surface 14 of the frame 10 and the joist 5, so that even if the technician keeps punching the screw, the mounting spacer 30 can prevent the screw from going deeper into the joist 5, so that the screw won't be punched excessively into the joist 5, and the flange 11 can perfectly contact the bottom of the joist 5, therefore the frame 10 can be installed horizontally with the ceiling 70.

According to FIGS. 7, 8A and 8B, a clipping structure 35 is provided on the mounting spacer 30, and the frame 10 has a clipping hole 15 which can lock up the clipping structure 35.

In the prior art, usually a gluing method is used when the mounting spacer 30 is needed to be fixed to the side surface 14 of the frame 10. It's not convenient, and the impact force applied when punching the screws may cause the glue peeled off, so that during the installation, the mounting spacer 30 may be detached from the frame 10.

In the present invention, the mounting spacer 30 is provided with the clipping structure 35, the frame 10 is provided with the clipping hole 15 clipping with the clipping structure 35. The clipping structure 35 is aligned with the clipping hole 15 of the frame 10 then inserted, so that the mounting spacer 30 is fixed to the frame 10, and the mounting hole 33 is aligned with the bore 20 in the frame 10. The installation could be easier and more convenient through mounting the mounting spacer 30 in advance.

Again as shown in FIG. 8A, the clipping structure 35 is a hollow cylinder and is comprised of a root circular ring 36 which projects from the inner side 31 of the mounting spacer 30 and a top circular ring 37 which is at the extension of the root circular ring 36, the radius of the top circular ring 37 is bigger than the radius of the clipping hole 15, the radius of the root circular ring 36 is smaller than the radius of the clipping hole 15.

In this embodiment, the clipping structure 35 is a hollow cylinder made of resin, and it is comprised a root circular ring 36 which projects from the inner side 31 of the mounting spacer 30, and a top circular ring 37 which at the extension of the root circular ring 36, the radius of the top circular ring 37 is 0.4 mm bigger than the radius of the clipping hole 15, so when clipping the clipping structure 35 into the clipping hole 15 in the side surface 14 of the frame 10, a user can tilt part of the top circular ring 37 and swing it into the clipping hole 15, then press the top circular ring 37 inwards to deform it, and stop pressing after both of the top circular ring 37 and the root circular ring 36 have been passed through the clipping hole 15. The top circular ring 37 recovers back to its original shape because no force is applied on it, and at this time, the clipping hole 15 locks the root circular ring 36 whose radius is 0.2 mm smaller than the clipping hole 15 and won't let it fall off. In this way, the mounting spacer 30 can be installed onto the frame 10 quickly and easily, so that the fixed installation of the frame 10 and the joist 5 is much easier (as shown in FIG. 6A).

As shown in FIGS. 7 and 8B, another type of the clipping structure 35 of the present invention comprises two parts, the first semicircle ring 351 and the second semicircle ring 352, which are formed by cutting the hollow cylinder clipping structure 35 along a direction from the top circular ring 37 to the root circular ring 36. Between the first semicircle ring 351 and the second semicircle ring 352, there is gap 353 of 1 mm, and a length of the gap 353 is bigger than the length resulted by subtracting the radius of the root circular ring 36 from the radius of the top circular ring 37. When clipping the clipping structure 35 into the clipping hole 15 in the side surface 14 of the frame 10, as the result of being pressed from outside to inside by a pressing force (such as force applied by a finger force), the first semicircle ring 351 and the second semicircle ring 352 will both be deformed towards the center of the circle (i.e. towards the inner side of the hollow cylinder). So that it's much easier to clip the clipping structure 35 into the clipping hole 15. After passing through the clipping hole 15, the top circular ring 37 recovers back to its original shape since the press force is no longer applied on it, and at this time, the clipping hole 15 is clipped on the root circular ring 36 whose radius is 0.2 mm smaller than the clipping hole 15. In this way, the mounting spacer 30 is easily fixed to the frame 10.

Again as shown in FIGS. 6A and 7, the mounting hole 33 in the mounting spacer 30 inclines from the outer side 32 of the mounting spacer 30 to the inner side 31 of the mounting spacer 30 at an angle A, the angle A is the same as an angle B at which the frame 10 inclines.

When threading the screw to the joist 5 from the inner side of the frame 10 through the bore 20 in the side surface 14 of the frame and the mounting hole 33 in the mounting spacer 30, since the angle A, at which the mounting hole 33 in the mounting spacer 30 inclines from the outer side 32 of the mounting spacer 30 to the inner side 31 of the mounting spacer 30, is the same as the angle B at which the frame 10 inclines, the mounting hole 33 can guide the screw to be threaded into the bore 20 in a direction vertically to the side surface 14 of the frame 10, such that the frame 10 can be stably mounted to the joist 5.

As shown in FIGS. 6B, 7 and 8A, a concave section 16 having an bore 20 and recessed towards the inner side of the frame 10 is provided in the side surface 14 of the frame 10, a frame mounting section 39 protrudes outwards from the inner side 31 of the mounting spacer 30, and the frame mounting section 39 and the concave section 16 have the same shape.

When viewing from a side, the concave section 16 has a solid triangular shape, the concave section 16 creates a first inclined surface 161 and a second inclined surface 162 which are connected with each other, the first inclined surface 161 is tilted downwards from the side surface 14 of frame 10 to the inner side of the frame 10, the second inclined surface 162 is tilted upwards from the side surface 14 of frame 10 to the inner side of the frame 10, the bore 20 is provided in the second inclined surface 162.

The frame mounting section 39 creates a third inclined surface 391 which is in parallel with the first inclined surface 161, and a fourth inclined surface 392 which is in parallel with the second inclined surface 162; the mounting hole 33 penetrates the fourth inclined surface 392, an inclination angle D at which the mounting hole 33 extends from the outer side 32 of the mounting spacer 30 to the inner side 31 of the mounting spacer 30, is the same as an inclination angle C at which the second inclined surface 162 inclines. When the inner space of the frame 10 is relatively small, it may lead to a case where there is not enough space left for the tools for threading the screw to get into the frame 10. For this reason, this embodiment describes a case where the concave section 16 is shown as a solid triangular shape, as shown in FIGS. 7 and 8A. Since the mounting section 39 of the mounting spacer and the concave section 16 have the same shape, the mounting section 39 is also shown as a solid triangular shape.

The concave section 16 creates two interconnected surfaces, a first inclined surface 161 and a second inclined surface 162, the first inclined surface 161 is tilted from the side surface 14 of frame 10 downwards and towards the inner side of the frame 10, the second inclined surface 162 is tilted from the side surface 14 of frame 10 upwards and towards the inner side of the frame 10; the frame mounting section 39 creates a third inclined surface 391 which is in parallel with the first inclined surface 161, and a fourth inclined surface 392 which is in parallel with the second inclined surface 162.

The bore 20 is provided in the second inclined surface 162, the mounting hole 33 penetrates the fourth inclined surface 392.

When the angle D, at which the mounting hole 33 inclines from the outer side 32 of the mounting spacer 30 to the inner side 31 of the mounting spacer 30, is the same as the angle C, at which the second inclined surface 162 inclines, the screw can be inserted into the bore 20 in a direction vertically to the inclined surface and then be tightened, as long as an inclined angle of the second inclined surface 162 is large enough, as shown in FIG. 6B, leaving a distance for an operation performed by a person's hand, for instance, 2 cm, between the vertical line 700 of the second inclined surface 162 and the end of the flange 11 on the side surface 17 opposite to the side surface 14 of the frame 10 through which the screw is passed, a contact between a tool for mounting the screw and a central space inside the frame 10 is avoided. In this way, the user could tilt the mounting device outwards from the opening in the bottom surface 13 of the frame 10, and thread the screw towards the upper portion of the side surface 14 of the frame 10 without being limited by the inner space of the frame 10, which makes the installation much easier. That is to say, the screw can be mounted to the frame 10 without being limited by the space inside the frame 10, such that the whole installation process is simple and easy.

As shown in FIGS. 7 and 8A, the clipping hole 15 is provided in the first inclined surface 161, while the clipping structure 35 is provided in the third inclined surface 391.

As the mounting section 39 is shown as a solid triangle, when the bore 20 is provided in the fourth inclined surface 392 and the mounting hole 33 is provided in the second inclined surface 162, if the clipping structure 35 is not provided on the frame mounting section 39, then it's necessary to leave a mounting space for the clipping structure 35 different from the frame mounting section 39, which increases the area of the mounting spacer 30. However, on the contrary, if the clipping structure 35 is provided on the third inclined surface 391 of the frame mounting section 39, and the clipping hole 15 is provided in the first inclined surface 161 of the frame 10, as the third inclined surface 391 is in parallel with the first inclined surface 161, the clipping structure 35 can be clipped into the clipping hole 15. In this way, the space for the installation can be saved, and so does the production cost.

Figure 9:
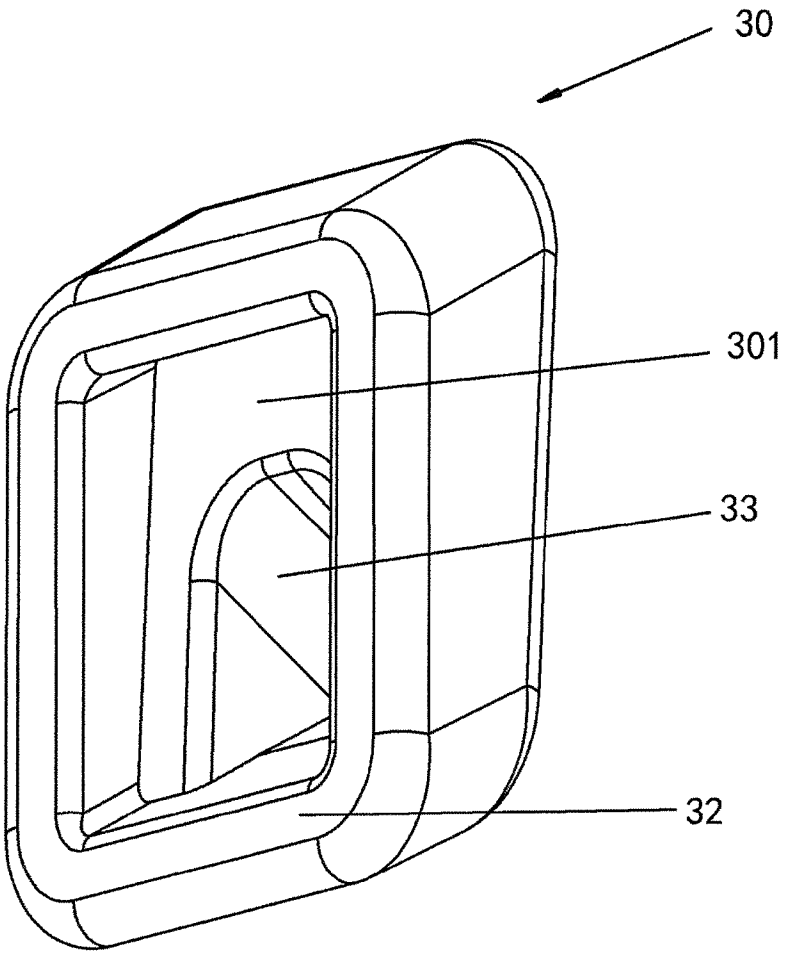
FIG. 9 is a schematic diagram showing the back side of the mounting spacer of the second embodiment of the present invention.

FIG. 9 is a schematic diagram showing the mounting spacer in the second embodiment of the present invention viewed from a different angle. As shown in FIGS. 6A and 9, outer side surface 32 of the mounting spacer 30 has a groove 301 which recesses from the outer side surface 32 to the inner side surface 31. When threading a screw into the joist 5, there will be a lot of wood chips spilt out, which may be later jammed between the joist 5 and the mounting spacer 30, such that the mounting spacer 30 cannot be completely matched with the joist 5, which could affect the stability of the installation. By using the structure mentioned above, even if wood chips are spilt out, the wood chips of the joist 5 can be received in the groove 301, so that they won't be jammed in the contacting space between the joist 5 and the mounting spacer 30, making the installation of the frame 10 and the joist 5 more stable and firm.

Figure 10:
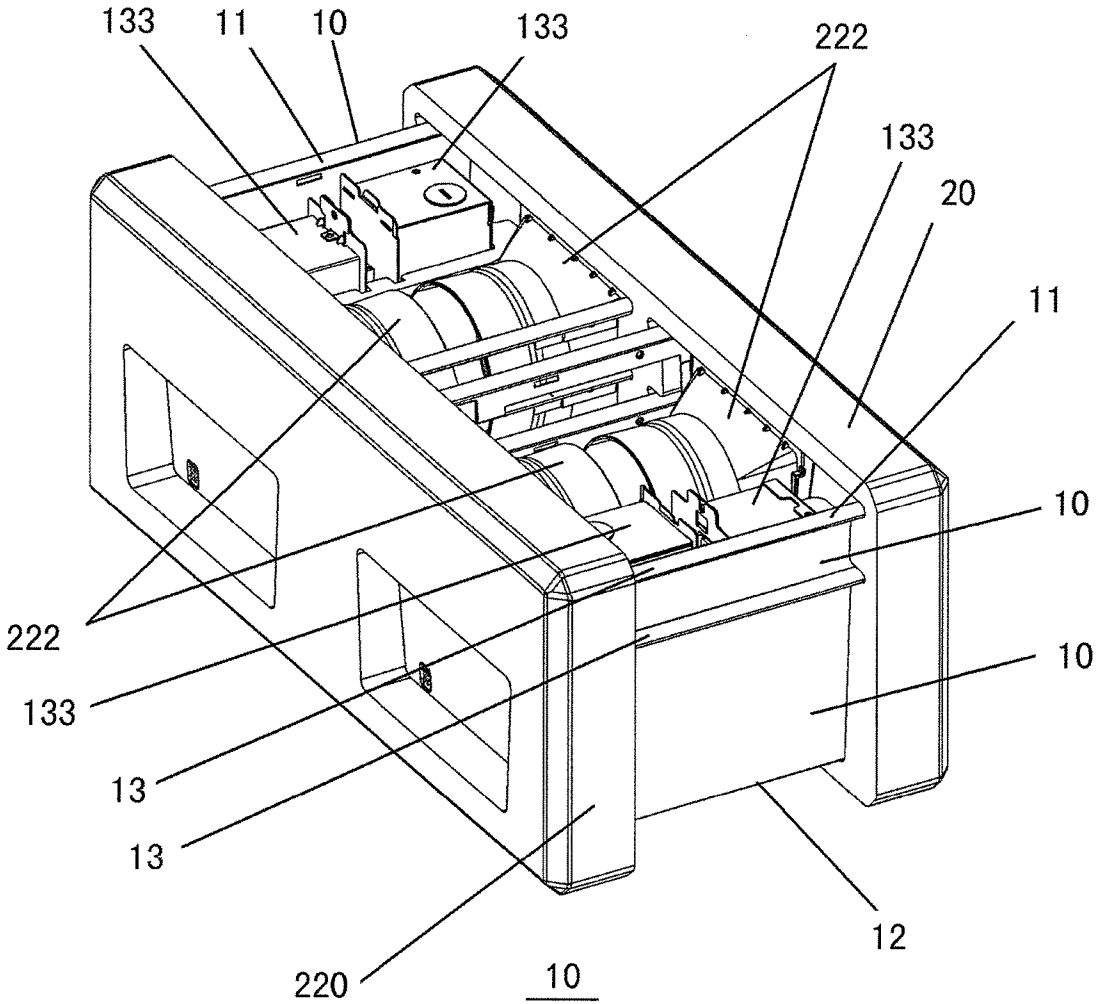
FIG. 10 is a schematic diagram showing that the frame is fixed by a fixing structure of the present invention.
Figure 11A:
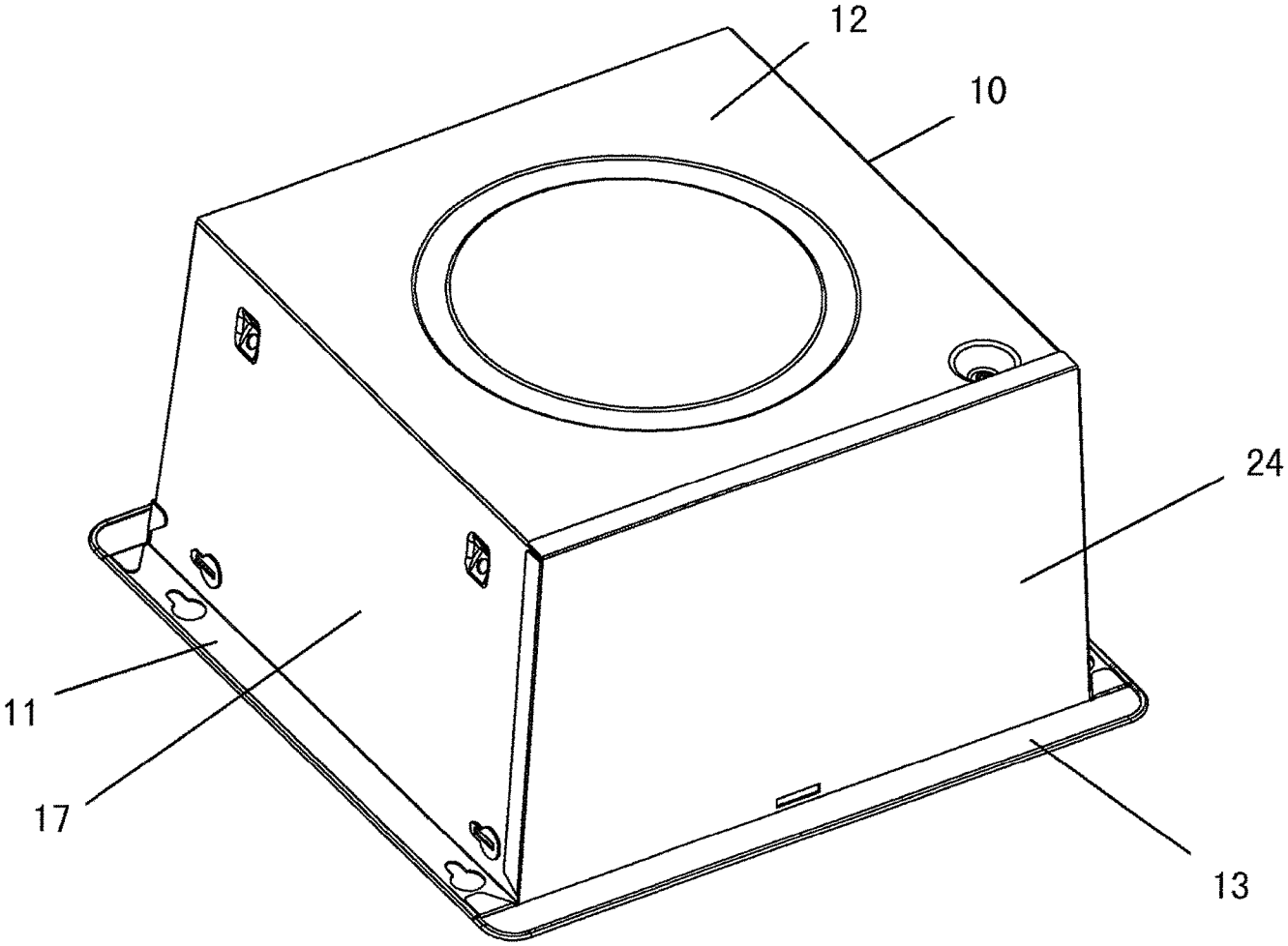
FIGS. 11A, 11B, and 11C are schematic diagrams showing a single packed frame from different viewing angles.
Figure 11B:
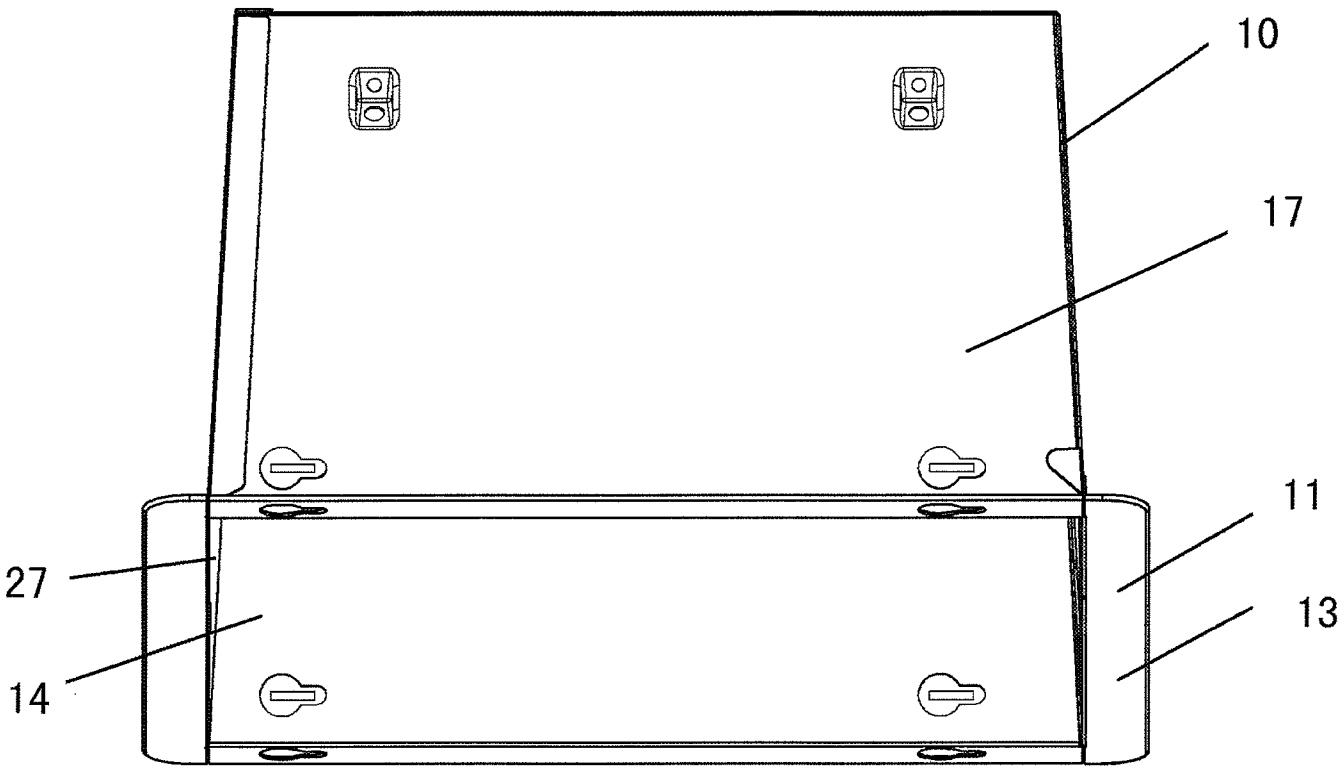
Figure 11C:
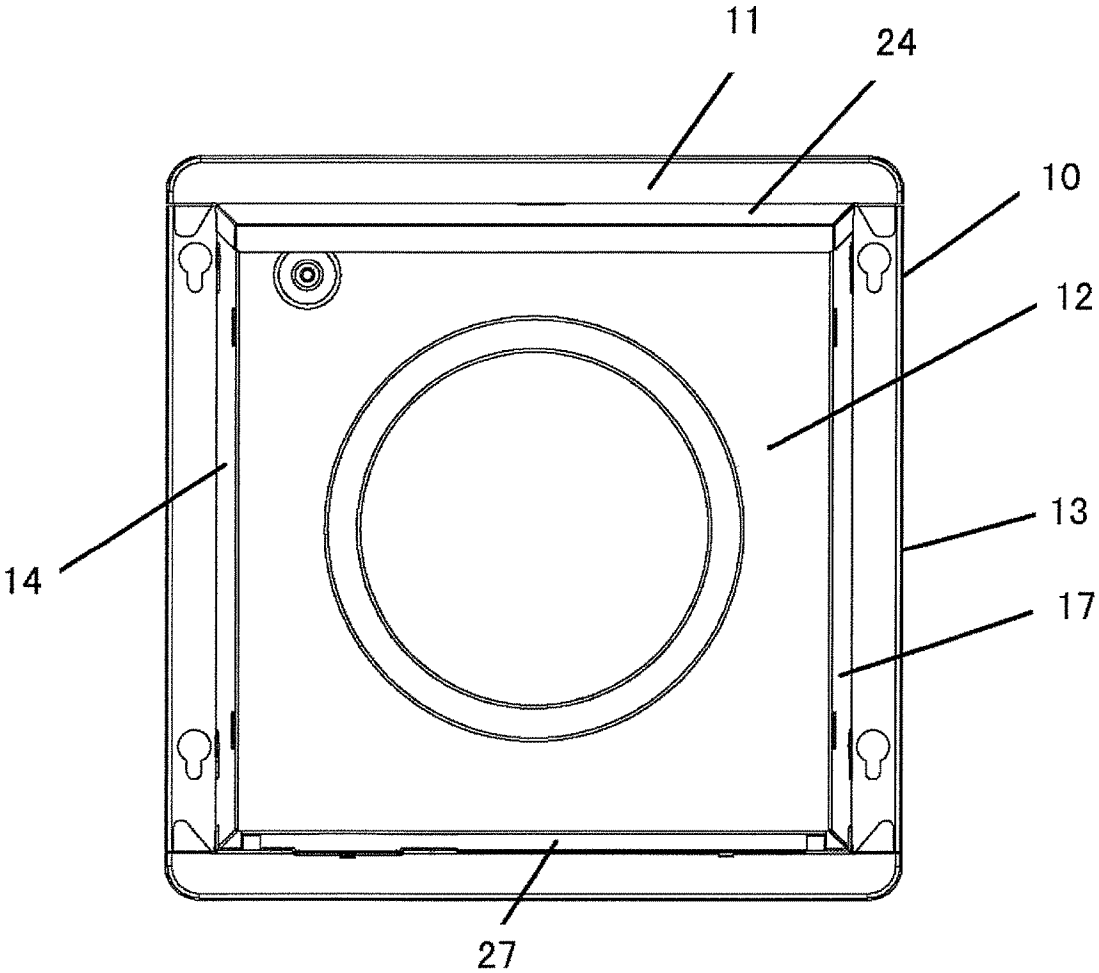
Figure 12A:
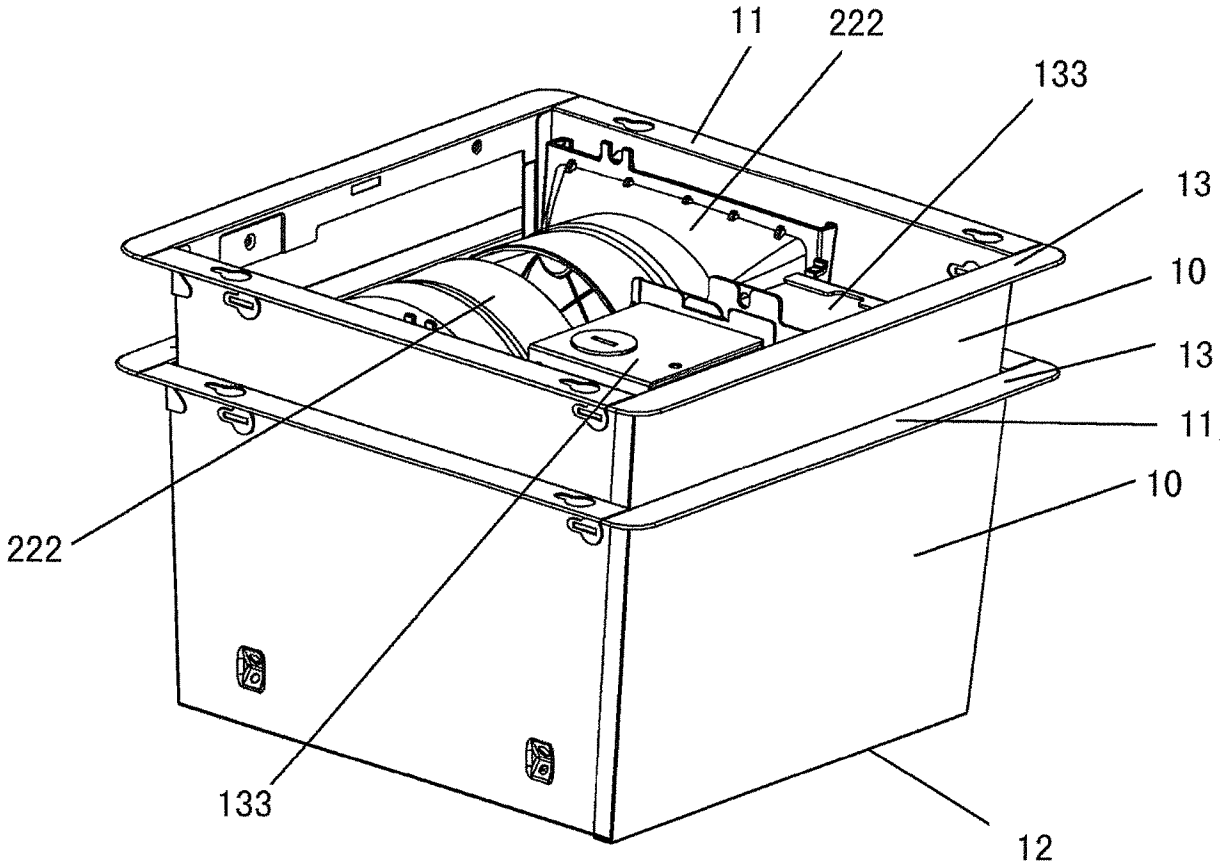
FIG. 12A is the schematic diagram showing two packed frames of the present invention from one viewing angle.
Figure 12B:
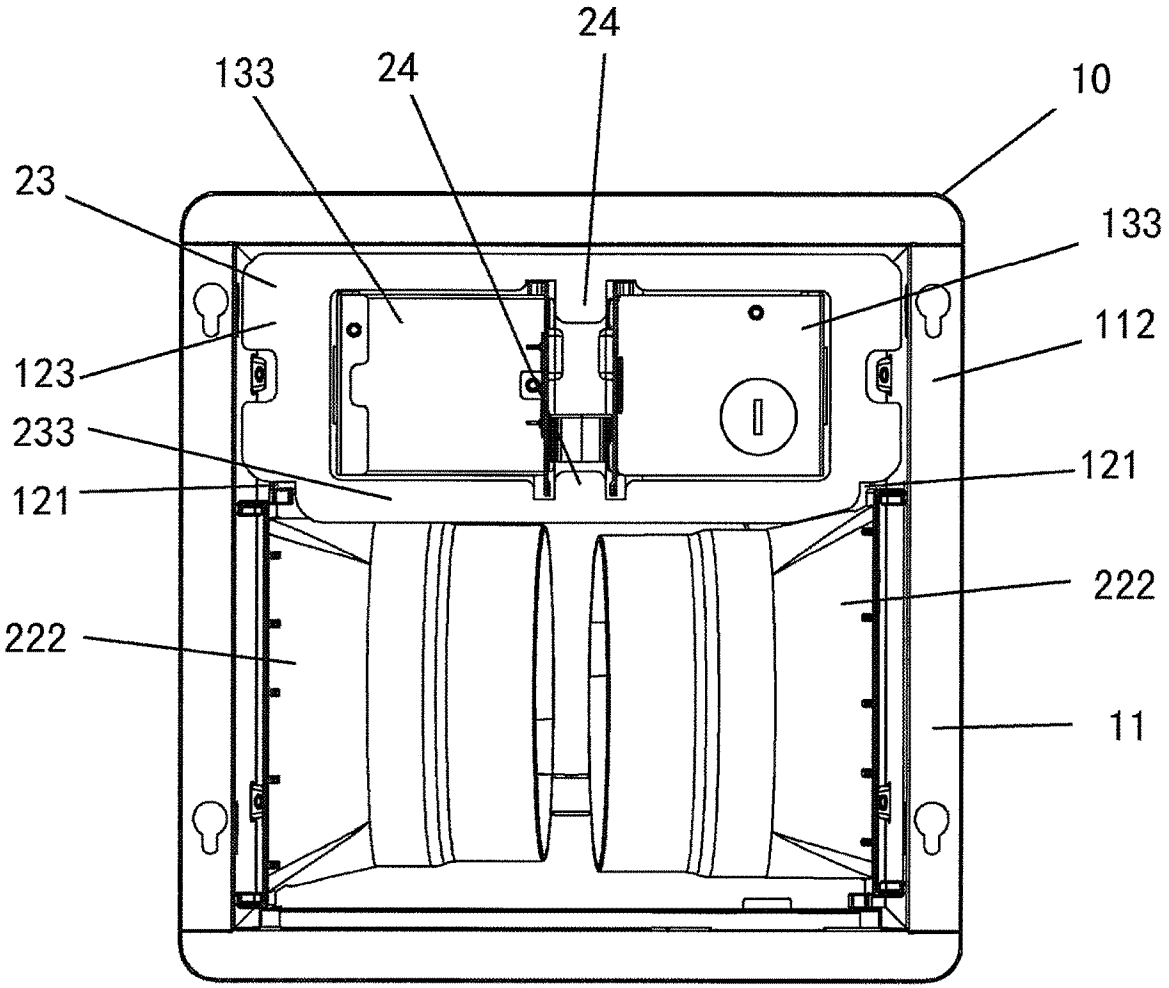
FIG. 12B is the schematic diagram showing the two packed frames of the present invention from another viewing angle.

FIG. 10 is a schematic diagram showing that the frame is fixed by a fixing structure of the present invention; FIGS. 11A, 11B, and 11C are schematic diagrams showing a single packed frame from different viewing angles; FIGS. 12A and 12B are the schematic diagrams showing the two packed frames of the present invention from different viewing angles.

As shown, components (the frame 10, the casing 211, the adapter 222 etc.) of the ventilation fan 1 of the present invention can be packed separately, and a packing structure 101 for the components comprises an outer packing carton (not shown) for packing the frame 10, the adapter 222, and the junction box 133 of the ventilation fan. Two fixing structures 220 are disposed inside the outer packing carton facing each other; frames 10 can be secured in a manner that two or more frames form a set and at least a plurality of sets are secured. The packing structure can be used to pack the ventilation fan 1 according to the first and the second embodiments. The embodiments of the present invention describe an example where two frames 10 form a pair and two sets of the frames 10 are packed inside the outer packing cartons. Except the top surface 12 and the bottom surface 13 of the frame 11, other four side surface 14, 17, 24, 27 tilt outwards from the top surface 12 to the bottom surface 13, the area of the opening in the bottom surface 13 is bigger than the area of the top surface 12; frames 10 in the same set are arranged longitudinally in an up-down direction, where the top surface 12 is directed downwards and the bottom surface 13 is directed upwards, the adapters 222 and the junction boxes 133 are contained inside of the frame 10 upmost in the longitudinal arrangement; frames 10 in different sets are arranged horizontally side by side.

Except the top surface 12 and the bottom surface 13 of the frame 10, other four side surface 14, 17, 24, 27 tilt outwards from the top surface 12 to the bottom surface 13, the area of the opening in the bottom surface 13 is bigger than the area of the top surface 12. In other words, the opening of the frame 10 expands via the four side surfaces 14, 17, 24, 27 from the top surface 12, to the bottom surface 13. With the above structure, when two frames 10 are arranged with the top surface 12 disposed downwards and the bottom surface 13 disposed upwards for an integrated packing, storage or transport, those two frames 10 are disposed longitudinally side by side, and the opening in the bottom surface 13 of the underlying frame 10 (hereinafter refers as "lower frame 10") could cover a part of the frame 10 on top (hereinafter refers as "upper frame 10") from the top surface 12 of the upper frame 10. In other words, the top surface 12 of the upper frame 10 can be inserted into the opening in the bottom surface 13 of the lower frame 10 and overlapped with the lower frame. In this way, a size of the frames 10 in the longitudinal direction will be reduced, so that heights of the fixing structure 220 for securing the frame 10 and the outer packing carton for packing the frame 10 can be reduced.

Since the adapters 222 and the junction boxes 133 are contained inside the topmost upper frame 10 not installed on the frame 10, there is no adapter 222 and junction box 133 between two horizontally arranged frames 10, therefore gaps between two frames 10 can be set to be relatively small, and a horizontal length of the fixing structures 220 for securing the frame 10 and the outer packing carton for packing the frame 10 can be reduced.

As two sets of frames 10 are horizontally arranged, spaces inside the topmost frames 10 of both sets may be used to contain the adapters 222 and the junction boxes 133.

FIG. 9 is a schematic diagram showing the fixing structure of the present invention. As shown, the fixing structure 220 is provided with two support sections 21, each support section 21 has two grooves 22 arranged side by side along a longitudinal direction and located at an upper portion of the support section 21 for insertion of the flange 11 of the frame 10. A distance H between the two grooves 22 is larger than 10 mm, but smaller than a height of the frame 10 in the longitudinal direction.

Since the side surfaces of the frame 10 tilt outwards from the top surface 12 to the bottom surface 13, theoretically, it's possible to insert the upper frame 10 into the opening in the bottom surface 13 of the lower frame 10 until the top surface 12 of the upper frame 10 clings to the top surface 12 of the lower frame 10. However, considering the manufacturing tolerance in practice (i.e. during the process of manufacturing the frame 10, the inclination angles of the side surfaces 14, 17, 24 and 27 may have small deviations), if the distance H between the two longitudinally side by side arranged grooves 22 for insertion of the flange 11 is set to a minimum 10 mm, then during packing process, flanges 11 of two longitudinally arranged frames 10 will be spaced apart by a distance of a minimum 10 mm, so that it can avoid a case where the upper frame 10 cannot be entirely fit into the inside of the lower frame 10 and thereby cannot utilize the packing structure of the present invention for packing due to the manufacture tolerance.

The distance H between the two grooves 22 is less than the height of the frame 10 (from the top surface 12 of the frame 10 to the bottom surface 13 of the frame 10), so that an interval between flanges 11 of two longitudinally arranged frames 10 will not be larger than the height of the frame 10, that is to say, the upper frame 10 can be inserted and packed into the lower frame 10. The longitudinal dimension of two overlapped frames in one set can be decreased, and the height of the fixing structure 220 for securing the frame 10 and outer packing carton for packing the frame 10 can be lowered. Therefore, even though there might be small deviations on the inclination angles of the side surfaces 14, 17, 24 and 27 of the frame 10, it can still make it easy to pack and transport, and at the same time save the packing cost and time.

Figure 14:
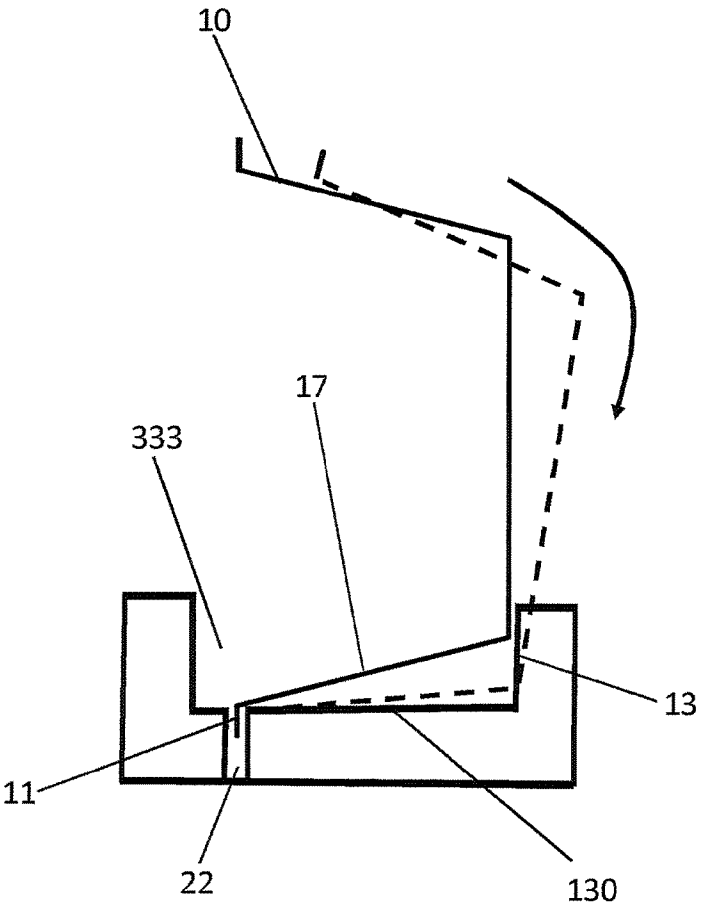
FIG. 14 is a schematic diagram showing a deformed frame, which is packed by an assumed fixing structure.

The support section 21 has a concave 333 to support some of the side surfaces 14, 17, 24, 27 of the frame 10 and the bottom surface 13, each side surfaces 117, 130, 119 of the concave 333 is inclined to match a respective side surface 14, 17, 24 and 27 of the frame 10. As seen in FIG. 14, FIG. 14 is a schematic diagram showing the deformed frame assuming that a fixing structure is used to pack the frame. Assuming one of the inclined side surfaces 130 of the concave 333 doesn't match the side surface 17 of the frame 10, but disposed in perpendicular to the bottom surface 120 of the concave 333, a gap will be formed between the side surface 130 of the concave 33 and the side surface 17 of the frame 10. So, when the outer packed carton falls off, only the flange 11 inserted in the groove and having a relative small thrust surface is impacted, so that the flange 11 might be deformed due to an overloaded force.

Therefore, by tilting the side surfaces 117, 130, 119 of the concave 333 to match with the side surfaces 14, 17, 24 and 27 of the frame 10, the frame 10 is embedded into the concave 333, side surfaces 14, 17, 24 and 27 can cling onto the side surfaces 117, 130, 119 of the concave 333, so that when the package is flipped over or fall off, not only the flange 11, but also some of the side surfaces 14, 17, 24 and 27 of the frame 10 will be subjected to the impact, thereby compression area is increased and pressure applied on the flange 11 is reduced, which prevent the flange 11 from being deformed. In this way, the frame 10 is protected, and in the mean time, it's easy to be transported.

Again as shown in FIGS. 10, 11A, 12B and 13, the top surface 12 and the bottom surface 13 of the frame 10 are rectangles, the number of the support sections 21 provided in the fixing structure 220 is the same as the number of the sets of the frames 10, and the two fixing structures 220 have the same shape.

In the first and the second embodiments, since the top surface 12 and the bottom surface 13 of the frame 10 are rectangles, length and width of each of the four side surfaces 14, 17, 24 and 27 of the frame 10 are the same. In addition, the adapters 222 and the junction boxes 133 are contained inside of the frame 10 without protruding from the frame 10, therefore, during packing, it doesn't matter which side surface of the frame 10 has been inserted into the support section 21.

The number of the support sections 21 provided in the fixing structure 220 is the same as the number of the sets of the frames 10, that is to say, each support section 21 supports one set of frame 10. Since the two fixing structures 220 have the same shape, i.e., the support sections 21 have the same shape, therefore the side surfaces 14, 17, 24 and 27 of the frame 10 can be inserted into either of the support sections 21. In addition, since the shape of the fixing structures 220 are the same, a single set of mould would be enough for the production, which could reduce the costs.

Figure 13:
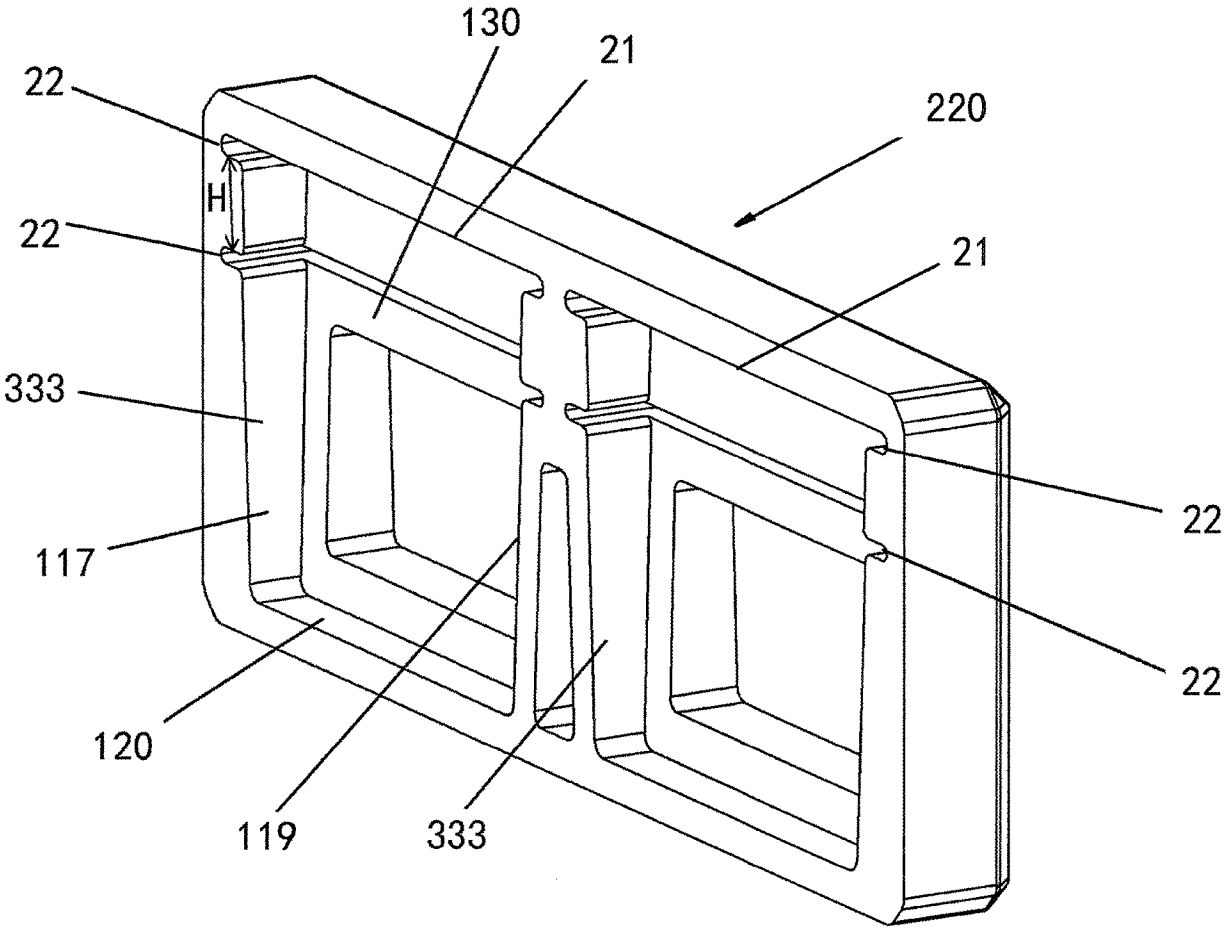
FIG. 13 is a schematic diagram showing the fixing structure of the present invention.

Again as shown in FIG. 13, the fixing structures 220 can be integrally formed. So no matter how many sets of frames 10 need to be packaged, there only needs two fixing structures 220 to secure all of the frames 10, which further simplifies the packing structure. It can reduce the costs, and save the time for packing.

As seen in FIG. 12B, when arranging two frames 10 longitudinally side by side as a set of frames 10, two junction boxes 133 and two adapters 222 are disposed inside the uppermost frame 10. Inside the frame 10, there is a separation structure 23 which surrounds the junction boxes 133 and has an opening at the bottom surface 13. A part of the separation structure 23 between two junction boxes 133 has a protrusion 24 projecting towards the inside of the separation structure 23.

When packaging, the junction boxes 133 are put into the separation structure 23 through the opening of the separation structure 23, such that the separation structure 23 surrounds the junction boxes 133, and then put the junction boxes 133 and the adapters 222 into the frame 10. As the separation structure 23 surrounds the junction box 133, the junction box 133 and the adapter 222 are separated by the separation structure 23, so is the case with the junction boxes 133 and the frame 10. In that way, only one separation structure 23 is needed to avoid the frictions and collisions between the junction boxes 133 and the frame 10 or the adapters 222.

Moreover, since the part of the separation structure 23 between two junction boxes 133 has a protrusion 24 projecting towards the inside of the separation structure 23, the junction boxes 133 will not be moved as they are constrained by the protrusion 24, which could avoid the frictions or collisions between two junction boxes 133.

Again as shown in FIG. 12B, outlets of two adapters 222 are placed as facing each other, clipping formations 121 for locking a lateral side of an inlet of each adapter 222 is provided at both ends of the side surface 233 of the separation structure 23 which lies between the junction box 133 and the adapter 222. With the structure described above, a lateral side of the inlet of the adapter 222 is clipped into the clip part 121, and the other lateral side of the inlet is pressed against the frame 10, so that the adapter 222 is locked between the clip part 121 and frame 10 and cannot be moved, and the adapters 222 will not impact each other. In this way, during transport, frictions or collisions between the plural adapters 222 can be avoid.

If both of the adapter 222 and the frame 10 are made of metal, then it is also an option to use the separation structure 23 to protect the adapter 222, and can provide the same function as the separation structure 23 used to separate the junction boxes 133, which will not be described here again.

What is claimed is:

1. A packing structure for a plurality of ventilation fans, each of the plurality of ventilation fans comprising: a frame provided with an opening in a bottom surface thereof and a flange, the frame having a rectangular shape; a casing with a fan motor installed therein; and an adapter connected to an outlet of the casing, wherein four side surfaces of the frame, except a top surface and the bottom surface thereof, incline outwards and downwards from the top surface to the bottom surface, an area of the opening in the bottom surface is larger than an area of the top surface, wherein the packing structure for the plurality of ventilation fans comprises an outer packing carton for packing frames and adapters of the plurality of ventilation fans, and junction boxes, wherein two fixing structures facing each other are disposed inside the outer packing cartons, and the frames are secured in a manner that the frames are secured in a plurality of sets, wherein each of the plurality of sets comprises two or more frames;

the frames in the same set are arranged longitudinally in an up-down direction where the top surface is directed downwards and the bottom surface is directed upwards, the adapters and the junction boxes are contained inside of a longitudinally upmost frame; and the frames in different sets are arranged side by side and horizontally.

2. The packing structure according to claim 1, wherein each of the two fixing structures is provided with a plurality of support sections, each support section is provided with a plurality of grooves for insertion of the flanges of the frames, the plurality of grooves are arranged longitudinally along the up-down direction and a distance between adjacent grooves is larger than 10 mm but less than a height of the frame in the up-down direction.

3. The packing structure according to claim 2, wherein a concave is formed in each of the plurality of support sections for supporting a part of the side surfaces of the frame and the bottom surface of the frame, and each side surface of the concave inclines to match with a respective side surface of the frame.

4. The packing structure according to claim 1, wherein the top surface and the bottom surface of the frame are rectangles; and each of the two fixing structures is provided with a plurality of support sections, the number of the plurality of support sections corresponds to the number of the plurality of sets of the frames, and the two fixing structures have the same shape.

5. The packing structure according to claim 1, wherein a separation structure having an opening in a bottom surface thereof and used for wrapping the junction boxes is provided inside the frame, and a portion of the separation structure between the junction boxes is provided with a protrusion that projects towards an interior of the separation structure.

6. The packing structure according to claim 5, wherein outlets of every two adapters are placed as facing each other, and each of both ends of a side surface of the separation structure between the junction boxes and the adapters is provided with a clipping formations into which a lateral side of an inlet of each adapter is locked.

7. The packing structure according to claim 1, wherein a separation structure having an opening in a bottom surface thereof and used for wrapping the adapters is provided inside the frame, and a portion of the separation structure between the adapters is provided with a protrusion that projects towards an interior of the separation structure.

* * * * *